US010321227B2

(12) United States Patent
Kim et al.

(10) Patent No.: US 10,321,227 B2
(45) Date of Patent: Jun. 11, 2019

(54) ELECTRONIC DEVICE FOR CONTROLLING MICROPHONE PARAMETER

(71) Applicant: Samsung Electronics Co., Ltd., Gyeonggi-do (KR)

(72) Inventors: Chul Kwi Kim, Gyeonggi-do (KR); Eun Young Kim, Seoul (KR); Dong Kyu Lee, Seoul (KR); Ja Min Goo, Gyeonggi-do (KR); Ki Young Kwon, Gyeonggi-do (KR); Ki Won Kim, Gyeonggi-do (KR); Ji Min Kim, Busan (KR); Hyung Woo Kim, Gyeonggi-do (KR); Joo Namkung, Gyeonggi-do (KR); Je Heon Park, Gyeonggi-do (KR); Sae Gee Oh, Gyeonggi-do (KR); Seong Hoon You, Gyeonggi-do (KR); Yong Ju Yu, Seoul (KR); Im Sung Lee, Gyeonggi-do (KR); Chan Won Lee, Gyeonggi-do (KR); Si Hak Jang, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 1 day.

(21) Appl. No.: 15/822,440

(22) Filed: Nov. 27, 2017

(65) Prior Publication Data

US 2018/0152784 A1 May 31, 2018

(30) Foreign Application Priority Data

Nov. 25, 2016 (KR) ..... 10-2016-0158515

(51) Int. Cl.

| | |
|---|---|
| ***H04R 25/00*** | (2006.01) |
| ***H04R 1/32*** | (2006.01) |
| ***H04R 1/02*** | (2006.01) |

(52) U.S. Cl.

CPC ..... *H04R 1/326* (2013.01); *H04R 1/02* (2013.01); *H04R 1/028* (2013.01); *H04R 2201/025* (2013.01); *H04R 2499/15* (2013.01)

(58) Field of Classification Search

None

See application file for complete search history.

(56) References Cited

U.S. PATENT DOCUMENTS

| | | | | |
|---|---|---|---|---|
| 6,516,066 | B2 | 2/2003 | Hayashi | |
| 7,873,439 | B2 * | 1/2011 | Nakamoto | G05D 1/0246 700/254 |

(Continued)

FOREIGN PATENT DOCUMENTS

| | | | |
|---|---|---|---|
| KR | 2003-0001668 | A | 1/2003 |
| KR | 10-1107120 | B1 | 1/2012 |

(Continued)

OTHER PUBLICATIONS

International Search Report dated Mar. 14, 2018.

*Primary Examiner* — Phylesha Dabney

(74) *Attorney, Agent, or Firm* — Cha & Reiter, LLC.

(57) ABSTRACT

An electronic device includes a housing including a head part that is rotatable, a plurality of microphones disposed in the head part, a sensor for detecting a rotation angle of the head part, a memory storing data classifying feature parameters for each of the plurality of microphones according to a plurality of rotation angles, a motor configured to rotate the head part; and a processor. The processor implements the method, including when detecting sound by the plurality of microphones originating from a sound source, driving the motor to rotate the head part until a designated portion of a surface of the head part is facing the sound source, and when the designated portion of the surface is facing the sound source, adjusting feature parameters for each the plurality of (Continued)

microphones based on the classified feature parameters and a current angle of the head part.

20 Claims, 16 Drawing Sheets

(56) References Cited

U.S. PATENT DOCUMENTS

| | | | | |
|---|---|---|---|---|
| 8,059,150 | B2 * | 11/2011 | Gal | G08B 13/19628 348/143 |
| 9,930,462 | B2 | 3/2018 | Goshen et al. | |
| 2001/0028719 | A1 | 10/2001 | Hayashi | |
| 2013/0332156 | A1 | 12/2013 | Tackin et al. | |
| 2016/0080880 | A1 | 3/2016 | Goshen et al. | |

FOREIGN PATENT DOCUMENTS

| | | | |
|---|---|---|---|
| KR | 10-1394168 | B1 | 5/2014 |
| KR | 10-2014-0077422 | A | 6/2014 |

* cited by examiner

ELECTRONIC DEVICE FOR CONTROLLING MICROPHONE PARAMETER

CLAIM OF PRIORITY

This application claims the benefit under 35 U.S.C. § 119(a) of a Korean patent application filed on Nov. 25, 2016 in the Korean Intellectual Property Office and assigned Serial number 10-2016-0158515, the entire disclosure of which is hereby incorporated by reference.

TECHNICAL FIELD

The present disclosure relates to a technology that adjusts parameters of a microphone.

BACKGROUND

An electronic device equipped with a component (e.g., a microphone) capable of recognizing voice information has been widely distributed with the development of a speech recognition technology. The electronic device may receive information corresponding to a user's voice using the component. If the information is received through the component, the electronic device may change the intensity or the pitch of the voice to generate a digital signal. The electronic device may amplify the changed digital signal and output the amplified signal through a speaker, or may control other components by using the changed digital signal.

SUMMARY

An electronic device may include one or more microphones. Since the locations of the microphones are different from each other in the electronic device, the intensity of voice information, a reception rate, or the like that is received by each of the microphones may be different in spite of voice information generated from the same sound source. For example, a microphone close to a sound source may receive voice information of strong intensity. On the other hand, a microphone far away from the sound source may receive voice information of weak intensity. If the intensity of voice information, the reception rate, or the like that is received by each of the microphones is different, the speech recognition rate of the electronic device may be reduced.

To provide an electronic device for solving the above-described problem and problems brought up in this specification.

In accordance with an aspect of the present disclosure, an electronic device a housing including a head part that is rotatable, a plurality of microphones disposed in the head part, a sensor for detecting a rotation angle of the head part, a memory storing data classifying feature parameters for each of the plurality of microphones according to a plurality of rotation angles, a motor configured to rotate the head part, and a processor, executing: when detecting sound by the plurality of microphones originating from a sound source, driving the motor to rotate the head part until a designated portion of a surface of the head part is facing the sound source, and when the designated portion of the surface is facing the sound source, adjusting feature parameters for each the plurality of microphones based on the classified feature parameters and a current angle of the head part.

In accordance with an aspect of the present disclosure, an electronic device includes a housing including a head part that is rotatable, a plurality of microphones disposed on the head part, a sensor for detecting a rotation angle of the head part, a memory storing data classifying feature parameters of each of the plurality of microphones according to a plurality of rotation angles, a first motor configured to rotate the head part in a first direction, a second motor configured to rotate the head part in a second direction, a camera, and a processor, executing: if a sound from a sound source is detected by the plurality of microphones, drive the first motor to rotate the head part until one surface of the head part faces the sound source, if the one surface faces the sound source, detect the sound source using the camera, if the sound source is detected, drive the second motor until the sound source is disposed within a prespecified region of an image captured by the camera, if the sound source is disposed within the prespecified region, adjust feature parameters of each of the plurality of microphones based on classified feature parameters and a current angle of the head part.

Other aspects, advantages, and salient features of the disclosure will become apparent to those skilled in the art from the following detailed description, which, taken in conjunction with the annexed drawings, discloses various embodiments of the present disclosure.

According to various embodiments of the present disclosure, a microphone parameter may be adjusted depending on the slope of a head part, thereby improving the speech recognition rate of an electronic device.

In addition, according to various embodiments of the present disclosure, the direction that one surface of a head part faces may be changed depending on the location of a sound source, thereby recognizing user's face.

Besides, a variety of effects directly or indirectly understood through the present disclosure may be provided.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
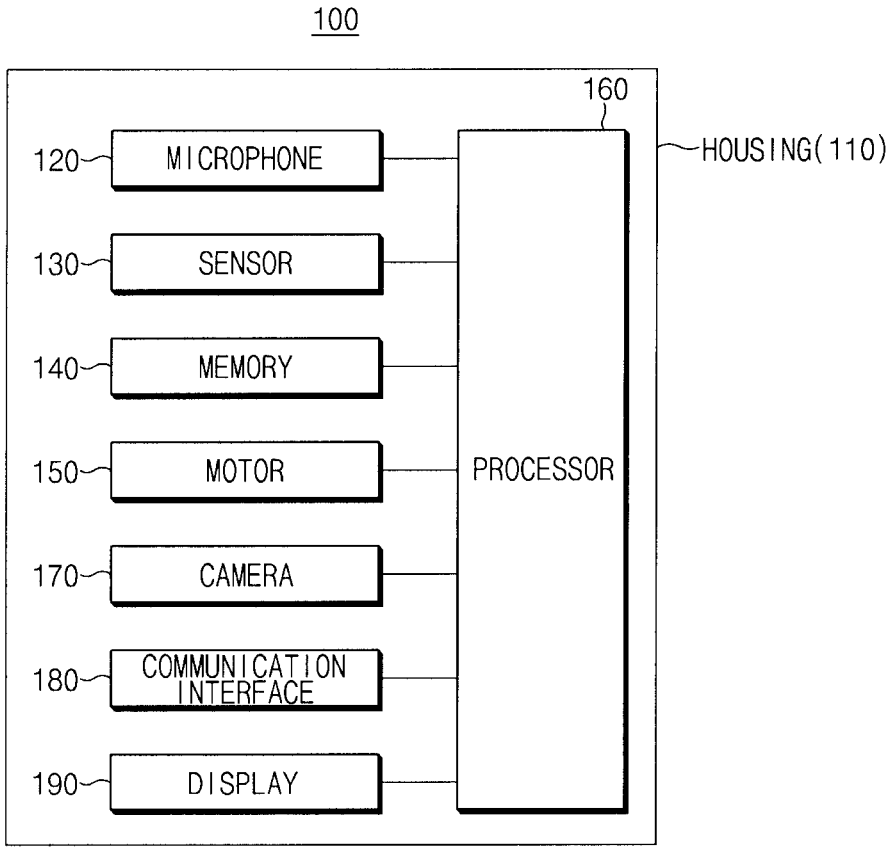
FIG. 1 illustrates a block diagram of an electronic device, according to an embodiment.

Hereinafter, various embodiments of the present disclosure may be described with reference to accompanying drawings. Accordingly, those of ordinary skill in the art will recognize that modification, equivalent, and/or alternative on the various embodiments described herein can be variously made without departing from the present disclosure. With regard to description of drawings, similar elements may be marked by similar reference numerals.

In this disclosure, the expressions "have", "may have", "include" and "comprise", or "may include" and "may comprise" used herein indicate existence of corresponding features (e.g., elements such as numeric values, functions, operations, or components) but do not exclude presence of additional features.

In this disclosure, the expressions "A or B", "at least one of A or/and B", or "one or more of A or/and B", and the like may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used in this disclosure may be used to refer to various elements regardless of the order and/or the priority and to distinguish the relevant elements from other elements, but do not limit the elements. For example, "a first user device" and "a second user device" indicate different user devices regardless of the order or priority. For example, without departing from the present disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it may be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening element (e.g., a third element).

According to the situation, the expression "configured to" used in this disclosure may be used as, for example, the expression "suitable for", "having the capacity to", "designed to", "adapted to", "made to", or "capable of". The term "configured to" may not mean only "specifically designed to" in hardware. Instead, the expression "a device configured to" may mean that the device is "capable of" operating together with another device or other components. For example, a "processor configured to (or set to) perform A, B, and C" may mean a dedicated processor (e.g., an embedded processor) for performing a corresponding operation or a generic-purpose processor (e.g., a central processing unit (CPU) or an application processor) which performs corresponding operations by executing one or more software programs which are stored in a memory device.

Terms used in this disclosure are used to describe specified embodiments and are not intended to limit the present disclosure. The terms of a singular form may include plural forms unless otherwise specified. All the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal unless expressly so defined in various embodiments of this disclosure. In some cases, even if terms are terms which are defined in this disclosure, they may not be interpreted to exclude embodiments of this disclosure.

An electronic device according to an embodiment of this disclosure may include at least one of, for example, smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, or wearable devices. According to an embodiment, the wearable device may include at least one of an accessory type (e.g., watches, rings, bracelets, anklets, necklaces, glasses, contact lens, or head-mounted-devices (HMDs), a fabric or garment-integrated type (e.g., an electronic apparel), a body-attached type (e.g., a skin pad or tattoos), or a bio-implantable type (e.g., an implantable circuit).

According to various embodiments, the electronic device may be a home appliance. The home appliances may include at least one of, for example, televisions (TVs), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ or PlayStation™), electronic dictionaries, electronic keys, camcorders, electronic picture frames, and the like.

According to another embodiment, an electronic device may include at least one of various medical devices (e.g., various portable medical measurement devices (e.g., a blood glucose monitoring device, a heartbeat measuring device, a blood pressure measuring device, a body temperature measuring device, and the like), a magnetic resonance angiography (MRA), a magnetic resonance imaging (MRI), a computed tomography (CT), scanners, and ultrasonic devices), navigation devices, Global Navigation Satellite System (GNSS), event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller's machines (ATMs), points of sales (POSs) of stores, or internet of things (e.g., light bulbs, various sensors, electric or gas meters, sprinkler devices, fire alarms, thermostats, street lamps, toasters, exercise equipment, hot water tanks, heaters, boilers, and the like).

According to an embodiment, the electronic device may include at least one of parts of furniture or buildings/structures, electronic boards, electronic signature receiving devices, projectors, or various measuring instruments (e.g., water meters, electricity meters, gas meters, or wave meters, and the like). According to various embodiments, the electronic device may be one of the above-described devices or a combination thereof. An electronic device according to an embodiment may be a flexible electronic device. Furthermore, an electronic device according to an embodiment of this disclosure may not be limited to the above-described electronic devices and may include other electronic devices and new electronic devices according to the development of technologies.

Hereinafter, electronic devices according to various embodiments will be described with reference to the accompanying drawings. In this disclosure, the term "user" may refer to a person who uses an electronic device or may refer to a device (e.g., an artificial intelligence electronic device) that uses the electronic device.

FIG. 1 illustrates a block diagram of an electronic device 100, according to an embodiment.

In this disclosure, the description given with reference to FIG. 1 may be identically applied to elements that have the same reference numerals as those of the electronic device 100 described with reference to FIG. 1. In addition, sound information in the present disclosure may include the voice or speech (voice information) of a human, machine sound, the sound of an animal, or the like. A sound source may be an object, which generates sound, such as a human, an animal, a vehicle, or the like.

Referring to FIG. 1, the electronic device 100 may include a housing 110, a microphone 120, a sensor 130, a memory 140, a motor 150, a processor 160, a camera 170, a communication interface 180, and a display 190.

The housing 110 may include an appearance of the electronic device 100. Each of elements of the electronic device 100 may be mounted inside the housing 110, and the housing 110 may protect the elements mounted inside the housing 110. In an embodiment, the housing 110 may include a head part provided to be rotatable. Alternatively, the housing 110 may include a head part provided to be rotatable and a body part supporting the head part.

The microphone 120 may be disposed on the head part and may receive sound information generated from the sound source. At this time, a microphone may include a plurality of microphones, and the locations of the plurality of microphones may be different from each other on the head part. Since the locations of the microphones are different from each other, the intensity of sound information input to each of the microphones, a time when the sound information is received, or the like may be different.

The sensor 130 (e.g., an inertial measurement unit (IMU) sensor) may be disposed inside the housing 110 and may sense a rotation angle of the head part. For example, if a head part 110*h* rotates on a body part 110*b*, the sensor 130 may sense the rotation angle according to the rotation of the head part 110*h*.

The memory 140 may store feature parameters of each of the microphones. The feature parameters may include the locations of the microphones, the gains of the microphones, a type of a tonal filter, and a type of a frequency filter. The memory 140 may store data obtained by classifying feature parameters depending on the rotation angle. Furthermore, the memory 140 may store an image associated with the sound source (e.g., user's face). The image associated with the sound source may be used in the case where the processor 160 recognizes the sound source.

The motor 150 may be disposed inside the electronic device 100 and may rotate the head part such that one side of the head part faces various directions. For example, the motor 150 may rotate (rotate in a sphere shape) the head part 360°. In another embodiment, the electronic device 100 may include a first motor that rotates the head part 110*h* in a first direction (e.g., a horizontal direction), and a second motor that rotates the head part 110*h* in a second direction (e.g., a vertical direction). The first direction and the second direction may be perpendicular to each other.

The processor 160 may adjust feature parameters for each microphone. For example, if the head part rotates, the sensor 130 may sense the rotation angle according to the rotation of the head part. If the rotation angle is sensed, the processor 160 may adjust feature parameters based on the data obtained by classifying the feature parameters depending on the rotation angle.

The camera 170 may capture an image. The image captured through the camera 170 may be stored in the memory 140. Moreover, the image captured through the camera 170 may be used for the processor 160 to recognize the user's face.

The communication interface 180 may transmit or receive data to or from an external device. The data may include text data, voice data, image data, or the like. The voice data may be output through a speaker, and the text data and the image data may be output through the display 190. According to an embodiment, the communication interface 180 may establish a communication channel associated with a video call with the external device.

Figure 2A:
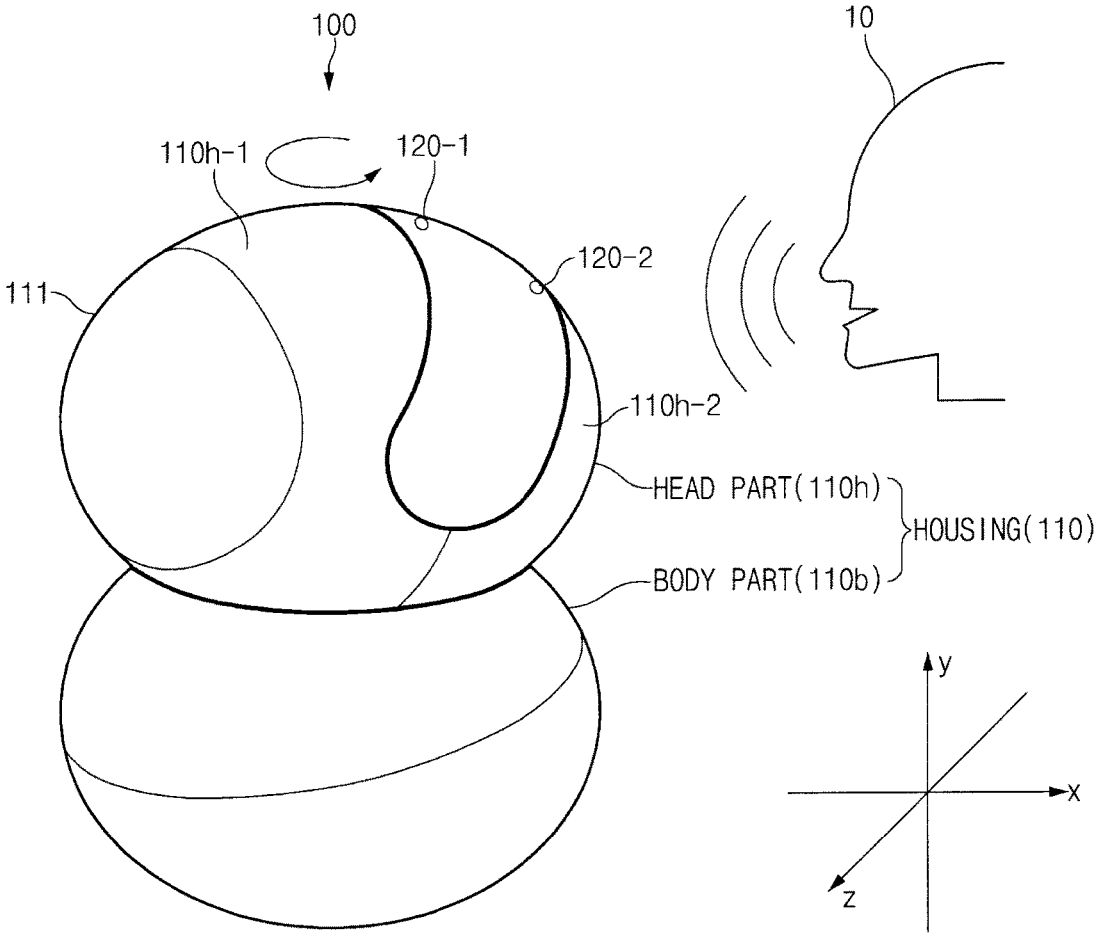
FIG. 2A illustrates a view in which a head part is rotating to face a sound source, according to an embodiment.
Figure 2B:
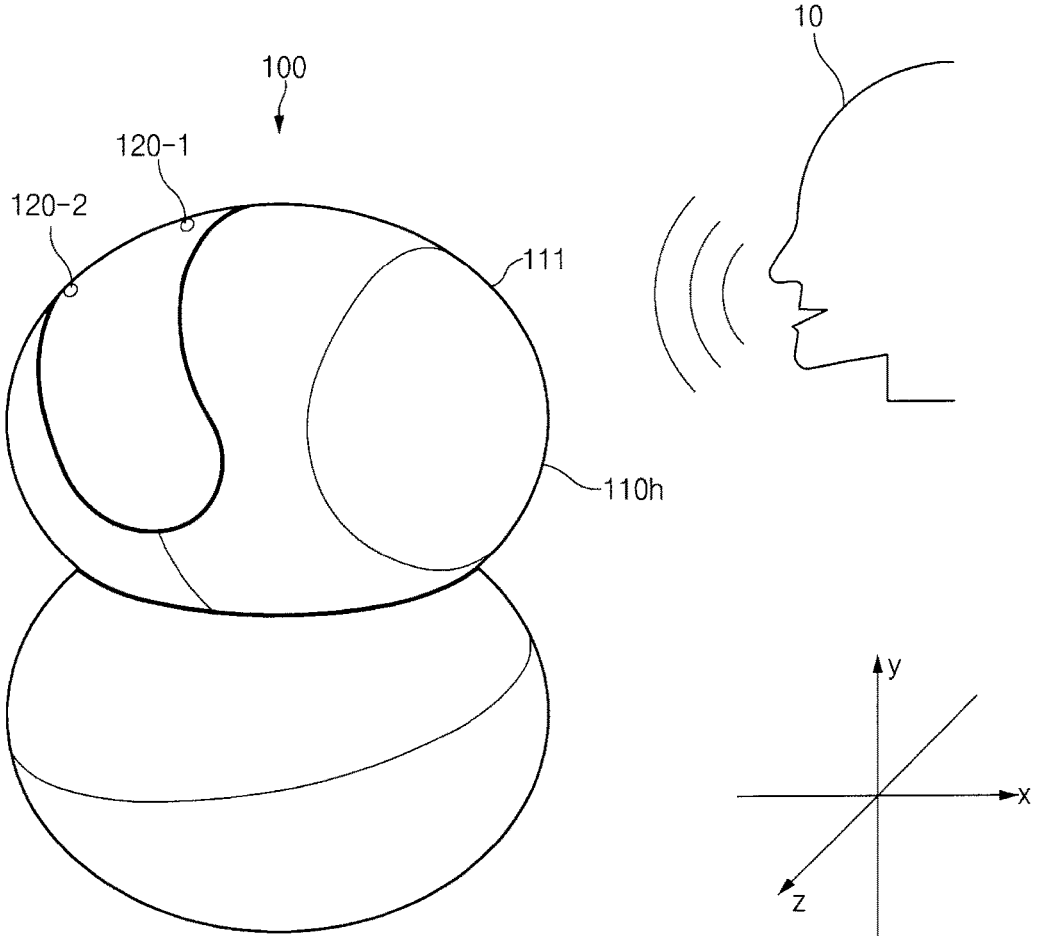
FIG. 2B illustrates a view in which the head part has rotated to face the sound source, according to an embodiment.

FIG. 2A illustrates a view in which the head part 110*h* rotates to face a sound source 10, according to an embodiment. FIG. 2B illustrates a view in which the head part 110*h* has rotated to face the sound source 10, according to an embodiment. The electronic device 100 illustrated in FIG. 2B illustrates a view in which the electronic device 100 has rotated.

Referring to FIG. 2A, the housing 110 may be implemented such that the head part 110*h* and the body part 110*b* are rotatably coupled to each other. The head part 110*h* may move while remaining disposed on the body part 110*b*. The body part 110*b* may be fixed to the ground or the like and may support the head part 110*h*. For example, a roller or the like may be interposed between the head part 110*h* and the body part 110*b* such that the head part 110*h* rotatably moves upon the body part 110*b*.

The camera 170, the display 190, and/or cover glass may be disposed on one surface 111 of the head part 110*h*. The camera 170 and the display 190 may be disposed inside the cover glass, and the cover glass may protect the camera 170 and the display 190 from an external shock. The cover glass may be formed of a transparent material such that the camera 170 captures an image or the display 190 outputs an image. For example, the cover glass may be formed of tempered glass, transparent plastic, a flexible polymer material, or the like.

A first microphone 120-1 and a second microphone 120-2 may be spaced apart on the head part 110*h* by a specific distance. For example, the first microphone 120-1 may be placed on a front surface 110*h*-1 of a head part (e.g., when the head part is divided in half, an area in which the camera 170, the display 190, or the like is placed). The second microphone 120-2 may be placed on a rear surface 110*h*-2 of the head part (e.g., an area other than the front surface 110*h*-1 in the head part).

The first microphone 120-1 and the second microphone 120-2 may receive sound information generated from the sound source 10. If the first microphone 120-1 and the second microphone 120-2 receive the sound information generated from the sound source 10, the processor 160 may control the motor 150 based on the received sound information such that the one surface 111 of the head part 110*h* is rotated to face the sound source 10.

For example, the processor 160 may obtain information about a direction of the sound source 10 based on a time (e.g., t1) when the first microphone 120-1 receives the sound information and a time (e.g., t2) when the second microphone 120-2 receives the sound information. If t1 is earlier than t2, the processor 160 may determine that the sound source 10 is located at a point closer to the first microphone 120-1 than the second microphone 120-2. In addition, the processor 160 may determine that the sound source 10 is generated at a point further away from the electronic device 100 as a time difference between t1 and t2 decreases. In FIG. 2A, the time when the second microphone 120-2 receives the sound information may be earlier than the time when the first microphone 120-1 receives the sound information. Accordingly, the processor 160 may determine that the sound source 10 is generated in X direction with respect to the electronic device 100.

Referring to FIG. 2B, the processor 160 may control the motor 150 such that the one surface 111 of the head part 110*h* rotates to face the sound source 10. In FIG. 2A, since the processor 160 determines that the sound source 10 is located in an "X" direction with respect to the electronic device 100, the processor 160 may control the motor 150 such that the one surface 111 of the head part 110*h* faces the X direction. Unlike illustration of FIG. 2B, the processor 160 may control the motor 150 depending on the location of the sound source 10 such that the one surface 111 of the head part 110*h* faces Y direction and/or Z direction.

If the one surface 111 of the head part 110*h* rotates to face the sound source 10, the sensor 130 may sense a rotation angle according to the rotation of the head part 110*h*. The rotation angle may indicate how much the head part 110*h* is inclined with respect to a tri-axis. For example, the sensor 130 may sense how much the head part 110*h* is inclined with respect to X axis, Y axis, and/or Z axis. If the rotation angle is sensed, the processor 160 may adjust feature parameters of microphones.

Figure 3:
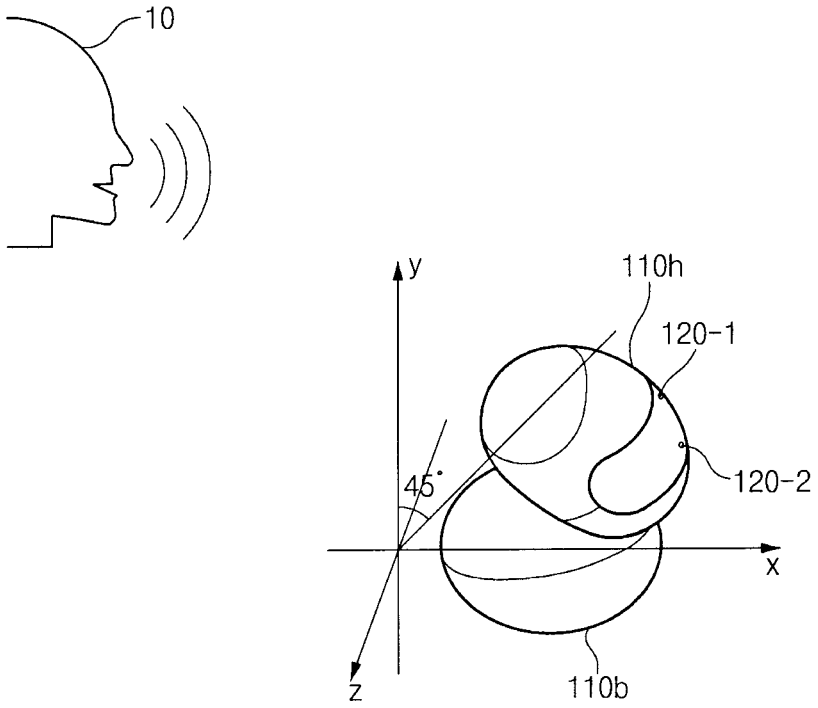
FIG. 3 illustrates an electronic device rotating a head part so as to face a sound source, according to an embodiment.

FIG. 3 illustrates the electronic device 100 rotating the head part 110*h* so as to face the sound source 10, according to an embodiment.

Referring to FIG. 3, the memory 140 may store feature parameters of each of microphones. In addition, the memory 140 may store data obtained by classifying each of a number of feature parameters depending on a rotation angle. For example, the memory 140 may store the data obtained by classifying the feature parameters depending on how much the head part 110*h* is inclined with respect to a tri-axis (X axis, Y axis, and/or Z axis).

TABLE 1

| | Motion angle (with respect to Y axis) | | | | | |
|---|---|---|---|---|---|---|
| | 15° | 30° | 45° | 60° | 75° | 90° |
| Parameter 1 (gain) | 5 | 7.5 | 10 | 12.5 | 15 | 17.5 |
| Parameter 2 (a type of a tonal filter) | Coloratura filter | Dramatic filter | Laric filter | Robust filter | Lyric filter | Leggiero filter |

TABLE 2

| | Motion angle (with respect to Y axis) | | | | | |
|---|---|---|---|---|---|---|
| | 15° | 30° | 45° | 60° | 75° | 90° |
| Parameter 1 (gain) | 10 | 20 | 30 | 40 | 50 | 60 |
| Parameter 2 (a type of a tonal filter) | Leggiero filter | Lyric filter | Robust filter | Laric filter | Dramatic filter | Coloratura filter |

Table 1 denotes data obtained by classifying parameters of the first microphone 120-1 depending on how much the head part 110*h* is inclined in X direction with respect to Y axis. Table 2 denotes data obtained by classifying parameters of the second microphone 120-2 depending on how much the head part 110*h* is inclined in X direction with respect to Y axis. Referring to Table 1 and Table 2, as the inclination degree of the head part 110*h* in X direction increases, the gain of a microphone may increase, and a type of a tonal filter may be different.

As described in FIG. 2B, if the one surface 111 of the head part 110*h* rotates to face the sound source 10, the sensor 130 may sense the rotation angle. In FIG. 3, the sensor 130 may sense that the head part 110*h* is inclined 45° in X direction with respect to Y axis.

If the sensor 130 senses the rotation angle, the processor 160 may adjust parameters of microphones based on the data. For example, in the case of the first microphone 120-1 of table 1, when the inclination degree of the head part 110*h* is 45°, the gain is '10' and the type of the tonal filter is a laric filter. Therefore, the processor 160 may set the gain of the first microphone 120-1 to '10' and may set the type of the tonal filter to the laric filter. For example, in the case of the second microphone 120-2 of table 2, when the inclination degree of the head part 110*h* is 45°, the gain is '30' and the type of the tonal filter is a robust filter. Therefore, the processor 160 may set the gain of the second microphone 120-2 to '30' and may set the type of the tonal filter to the robust filter.

According to an embodiment of the present disclosure, since the first microphone 120-1 is located closer to the location of the sound source 10 than the second microphone 120-2, the reception rate of sound information transmitted to the second microphone 120-2 may decrease compared with the first microphone 120-1. Accordingly, the processor 160 may set the gain of the second microphone 120-2 to a value greater than the gain of the first microphone 120-1. In addition, since the first microphone 120-1 is placed on the front surface of the head part 110*h* and the second microphone 120-2 is placed on the rear surface of the head part 110*h*, a tonal input to the first microphone 120-1 and a tonal input to the second microphone 120-2 may be different from each other. Accordingly, the processor 160 may set the tonal filter of the first microphone 120-1 and the tonal filter of the second microphone 120-2 to be different from each other.

According to an embodiment of the present disclosure, the feature parameter may be adjusted for each microphone depending on how much the head part 110*h* is inclined, thereby improving the speech recognition rate of the electronic device 100.

Figure 4:
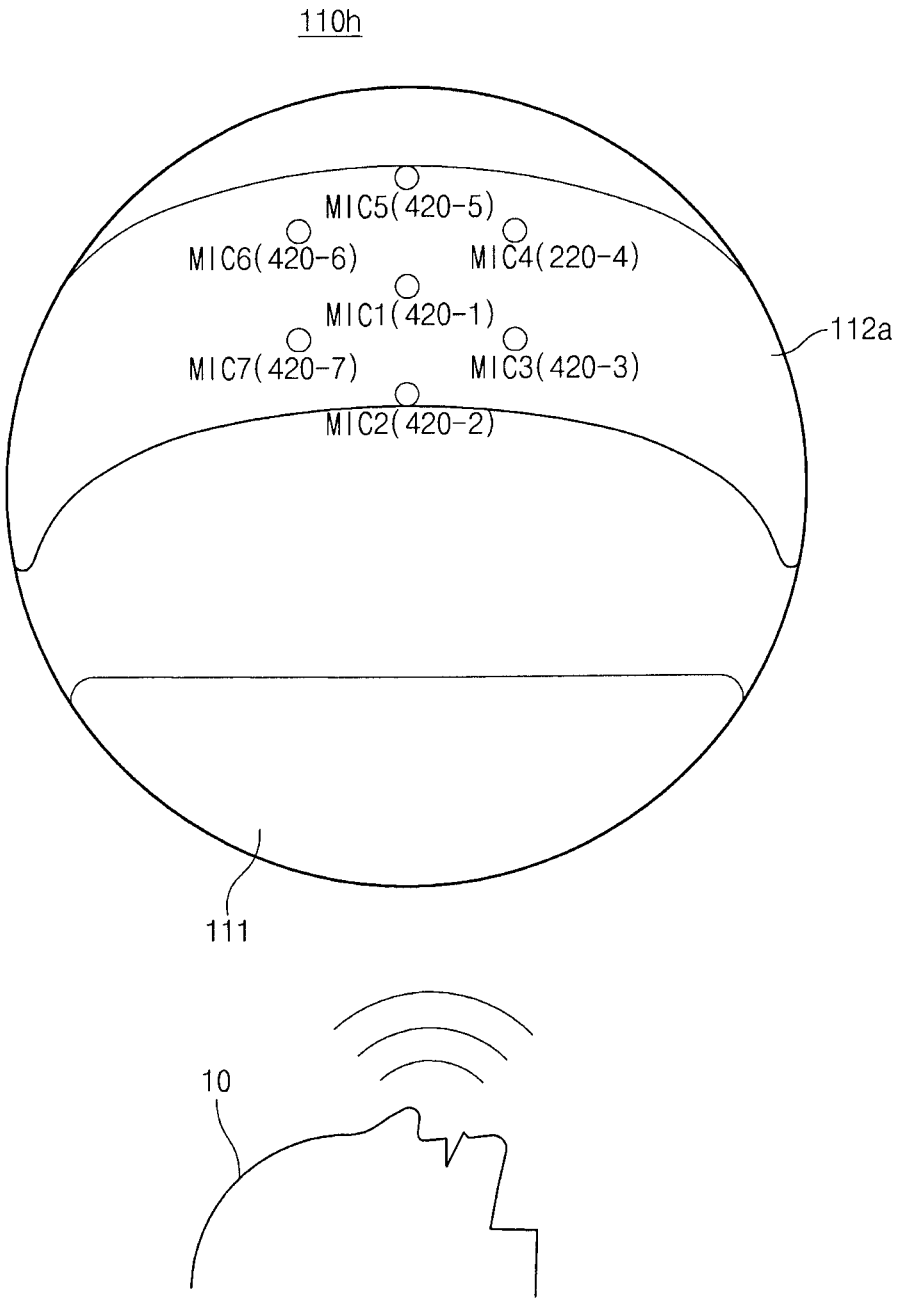
FIG. 4 illustrates a plan view of an electronic device, according to an embodiment.

FIG. 4 illustrates a plan view of the electronic device 100, according to an embodiment.

Referring to FIG. 4, unlike illustration illustrates in FIG. 2A, a plurality of microphones may be disposed in a partial area 112*a* of the head part 110*h*. For example, a first microphone 420-1 may be disposed at the center of the partial area 112*a*, and second to seventh microphones 420-2 to 420-7 may be disposed to surrounds the first microphone 420-1. If the first to seventh microphones 420-1 to 420-7 are disposed in the partial area 112*a*, a band may be disposed on the first to seventh microphones 420-1 to 420-7. The band may be formed of fabric or rubber such that the head part 110*h* does not slip in the case where a user grasps the head part 110*h*. Furthermore, a protrusion or the like may be formed on the surface of the band.

According to an embodiment of the present disclosure, the first to seventh microphones 420-1 to 420-7 may be implemented using the same type of microphone. In the case where the first to seventh microphones 420-1 to 420-7 are the same type of microphone, a rate at which each of the first to seventh microphones 420-1 to 420-7 receives sound information may be changed depending on the location of the sound source 10 and the rotation angle of the head part 110*h*. Accordingly, the processor 160 may change parameters of each of the first to seventh microphones 420-1 to 420-7 depending on the location of the sound source 10 and the rotation angle of the head part 110*h*.

According to an embodiment of the present disclosure, the processor 160 may increase the gain of a microphone disposed far away from the location of the sound source 10 and may decrease the gain of a microphone disposed close to the location of the sound source 10. For example, in FIG. 4, since the fifth microphone 420-5 is disposed far away from the location of the sound source 10, the intensity of the sound information received through the fifth microphone 420-5 may be weak. Accordingly, the processor 160 may determine that the fifth microphone 420-5 is disposed far away from the location of the sound source 10, and the processor 160 may increase the gain of the fifth microphone 420-5.

Since the second microphone 420-2 is disposed close to the location of the sound source 10, the intensity of the sound information received through the second microphone 420-2 may be strong. Accordingly, the processor 160 may determine that the second microphone 420-2 is disposed close to the location of the sound source 10, and may decrease the gain of the second microphone 420-2. The rate at which a microphone receives the sound information may be changed depending on a distance between the location of a microphone and the location of the sound source 10. However, according to an embodiment of the present disclosure, the gain of the microphone may be adjusted, thereby uniformly keeping the rate at which a microphone receives the sound information.

Figure 5:
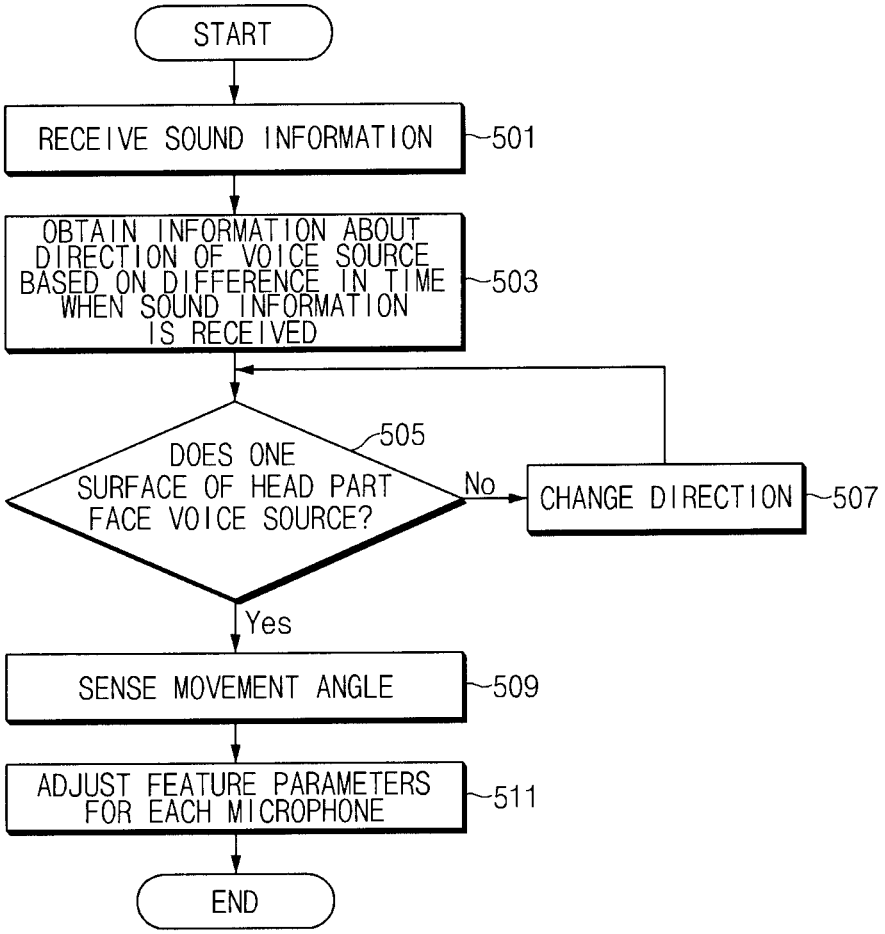
FIG. 5 illustrates an operation flowchart of an electronic device, according to an embodiment.

FIG. 5 illustrates an operation flowchart of the electronic device 100, according to an embodiment.

Referring to FIG. 5, in operation 501, microphones may receive sound information. If the sound information is received, in operation 503, the processor 160 may obtain information about the direction of a sound source based on a difference in a time when the sound information is received between multiple microphones (as illustrated above). For example, obtaining the information regarding the direction of a sounds source may correspond to the operation described in FIG. 2A. If the information about the direction of a sound source is obtained, in operation 505, the processor 160 may determine whether one surface of a head part of the device is presently facing the sound source. If the determination result indicates that the one surface of the head part is not presently facing the sound source, in operation 507, the processor 160 may control the motor 150 to rotate the head part such that the one surface of the head part is moved to face the sound source.

If the determination result indicates that the one surface of the head part faces the sound source, in operation 509, the sensor 130 may detect a rotation angle. Once the rotation angle is detected, in operation 511, the processor 160 may adjust feature parameters for each microphone according to the rotation angle. For example, the sensing, by the sensor 130, of the rotation angle and the adjusting, by the processor 160, of the feature parameters may correspond to the operation described in FIG. 3.

Figure 6A:
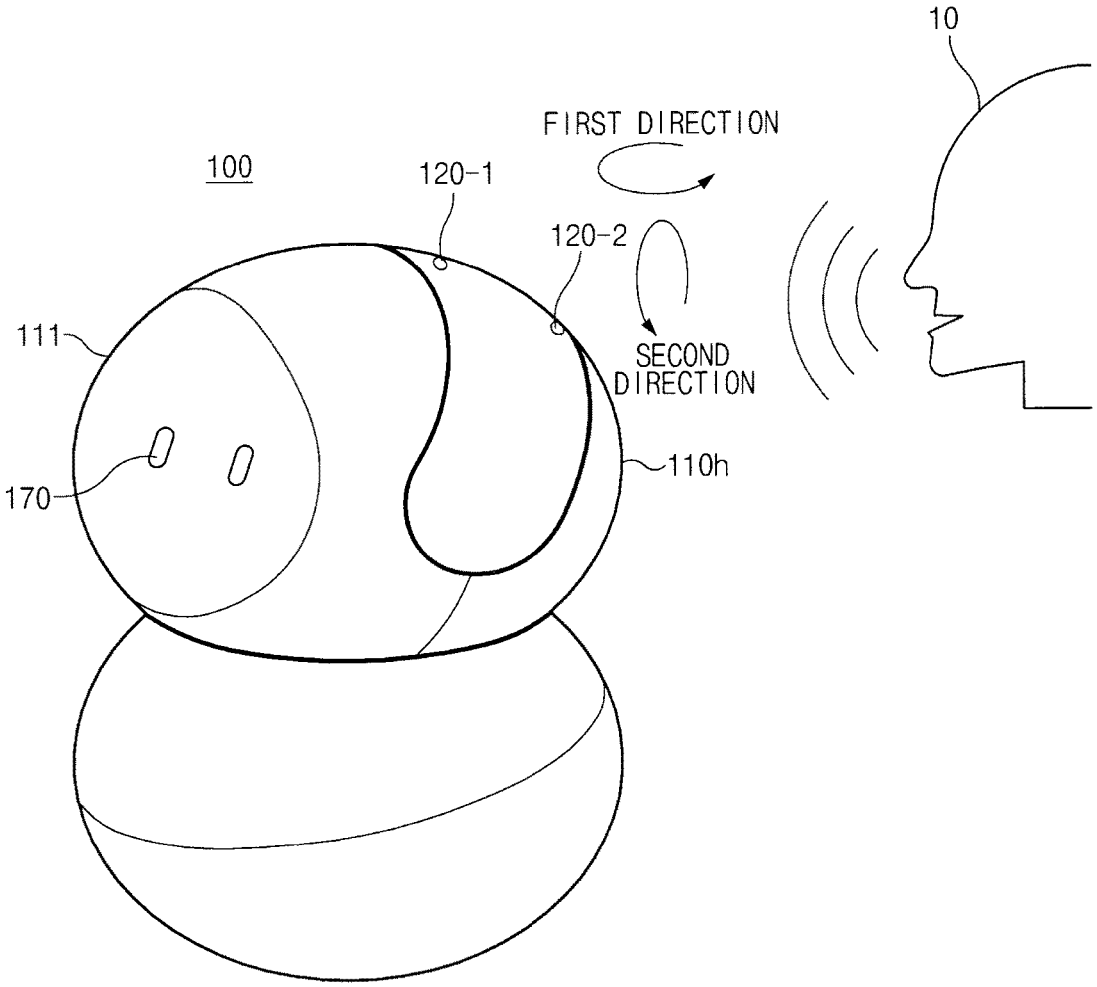
FIG. 6A illustrates an electronic device in which a camera is disposed on one surface of a head part, according to another embodiment.
Figure 6B:
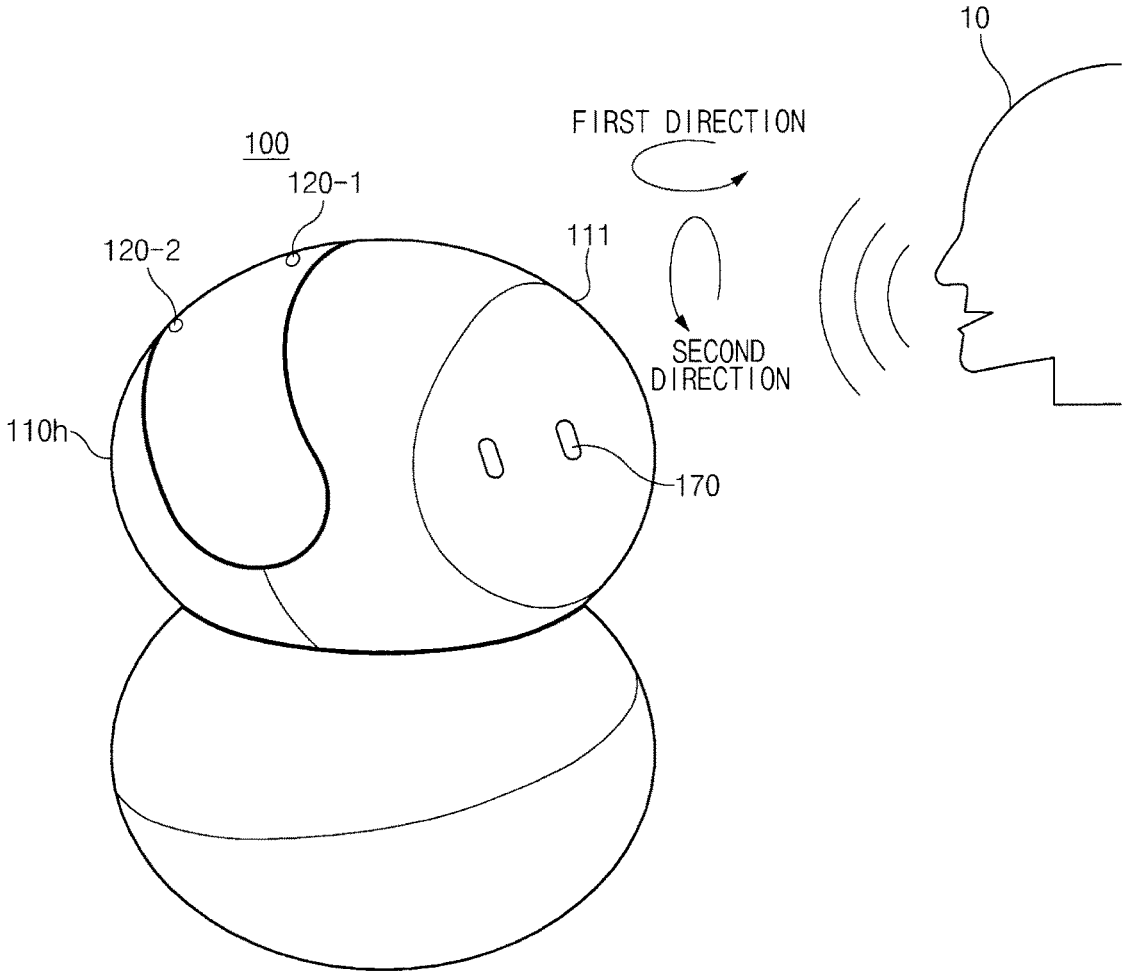
FIG. 6B illustrates an electronic device rotating in a first direction, according to another embodiment.
Figure 6C:
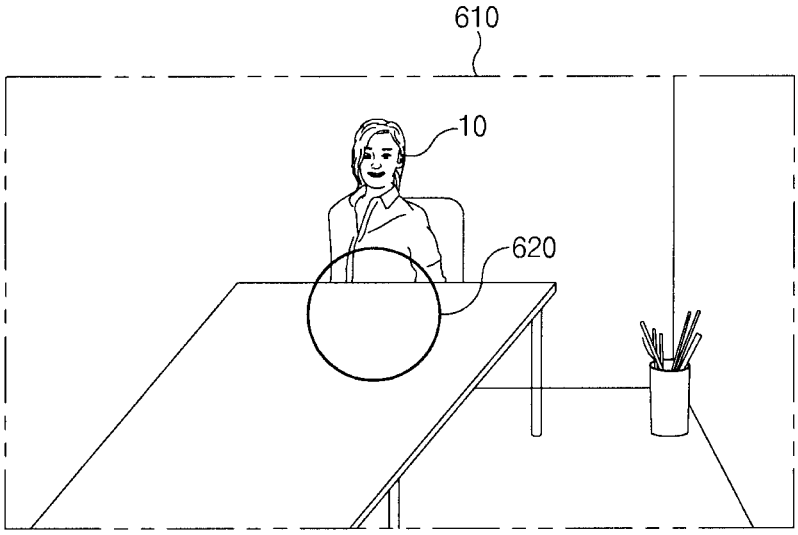
FIG. 6C illustrates an image input through a camera, according to another embodiment.
Figure 6D:
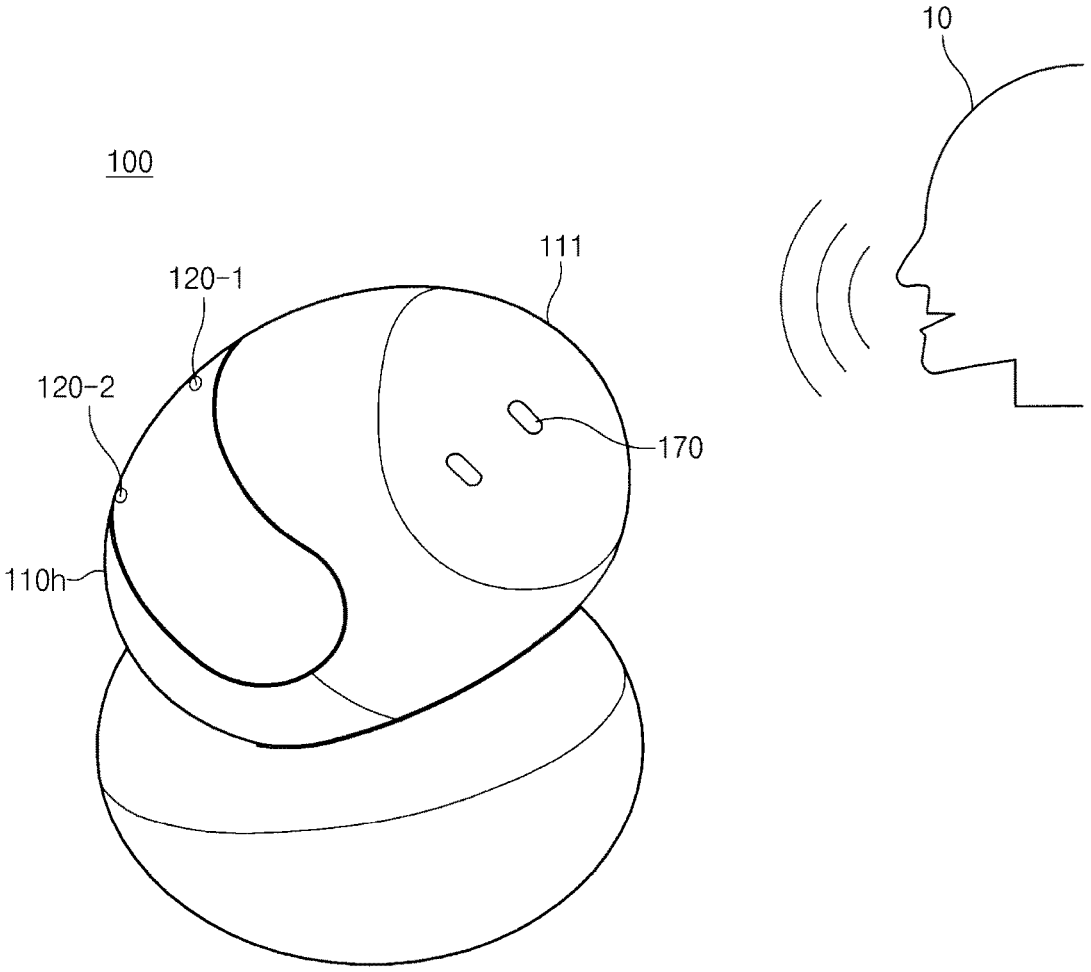
FIG. 6D illustrates an electronic device rotating in a second direction, according to another embodiment.

FIG. 6A illustrates the electronic device 100 in which the camera 170 is disposed on the one surface 111 of the head part 110*h*, according to another embodiment. FIG. 6B illustrates the electronic device 100 rotating in a first direction, according to another embodiment. The electronic device 100 illustrates in FIG. 6B illustrates a view in which the electronic device 100 illustrates in FIG. 6A rotates in the first direction. FIG. 6C illustrates an image input through the camera 170, according to another embodiment. FIG. 6D illustrates the electronic device 100 rotating in a second direction, according to another embodiment. The electronic device 100 illustrates in FIG. 6D illustrates a view in which the electronic device 100 illustrates in FIG. 6B rotates in the second direction.

Referring to FIG. 6A, the first microphone 120-1 and the second microphone 120-2 may receive sound information generated from the sound source 10. If the first microphone 120-1 and the second microphone 120-2 receive the sound information generated from the sound source 10, the processor 160 may obtain information about the direction of the sound source 10 based on the received sound information, and may control a first motor such that the one surface 111 of the head part 110*h* is rotated to face the sound source 10. A method of obtaining the direction of the sound source 10 may correspond to the method described in FIG. 2A. The first motor may be a motor capable of rotating the head part 110*h* in the first direction.

Referring to FIG. 6B, if the one surface 111 of the head part 110*h* faces the sound source 10, the processor 160 may recognize the sound source 10 through the camera 170. For example, the memory 140 may store an image associated with the sound source 10 (e.g., user's face), and the processor 160 may extract the feature point of the image stored in the memory 140. The processor 160 may compare the feature point of the image stored in the memory 140 with a feature point of an object input through the camera 170. If the comparison result indicates that the feature point of the image stored in the memory 140 is the same as the feature point of the object input through the camera 170, the processor 160 may recognize the object as the sound source 10.

If the sound source 10 is recognized, the processor 160 may control a second motor to rotate the device such that the sound source 10 is located within a specified area of the image input through the camera 170. The second motor may be a motor capable of rotating the head part 110*h* in the second direction. Referring to FIGS. 6C and 6D, an image 610 input through the camera 170 may include other objects other than the sound source 10. For example, if a user is in a meeting room, a desk, a chair, or the like, such environmental artifacts may be included in the image 610 input through the camera 170. A specified area 620 may be an area disposed at the center of the image 610 input through the camera 170. In FIG. 6C, since the sound source 10 is disposed within the specified area 620, as illustrates in FIG. 6D, if the head part 110*h* rotates in the second direction, as to maintain the sound source 10 within the specified area 620. According to an embodiment of the present disclosure, the head part 110*h* may rotates in the second direction such that the sound source 10 is included in the specified area. Accordingly, a motor may be controlled such that the one surface 111 of the head part 110*h* is continually rotated to accurately face the sound source 10.

Figure 7:
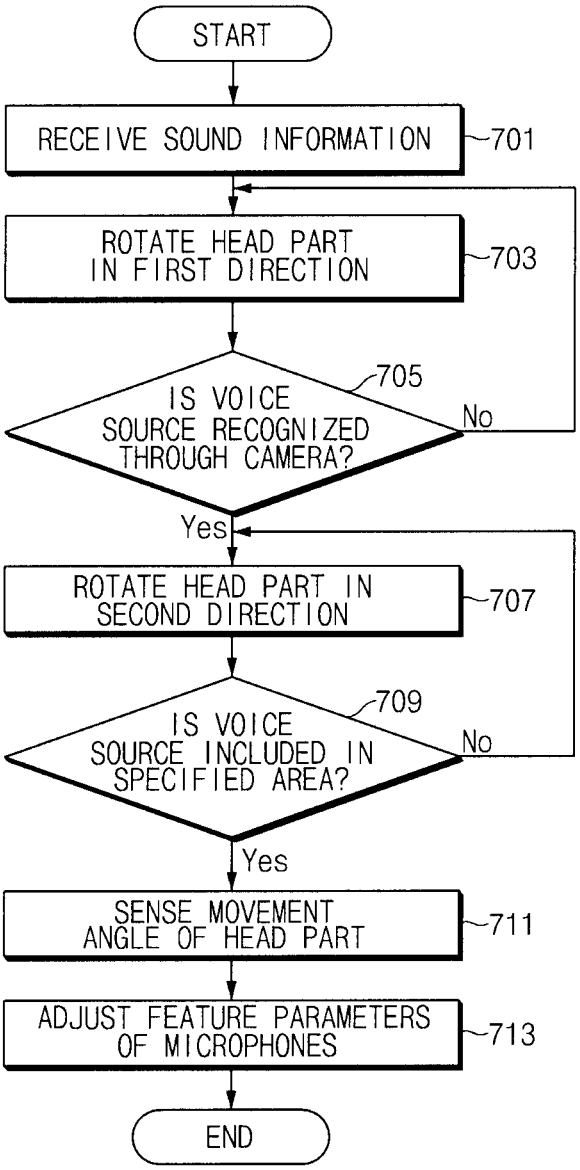
FIG. 7 illustrates an operation flowchart of an electronic device, according to another embodiment.

FIG. 7 illustrates an operation flowchart of the electronic device 100, according to another embodiment.

Referring to FIG. 7, in operation 701, microphones may receive sound information. If the sound information is received, in operation 703, the processor 160 may control a first motor such that one surface of the head part 110*h* faces a sound source. For example, the controlling, by the processor 160, of first motor may correspond to the operation described in FIG. 6A.

If the one surface of the head part 110*h* rotates to face the sound source, in operation 705, the processor 160 may determine whether the sound source is recognized through the camera 170. If the determination result indicates that the sound source is not recognized through the camera 170, the processor 160 may rotate the head part 110*h* in a first direction or according to a first rotation adjustment. For example, if there is no sound source 10 in the image 610 input through the camera 170, the processor 160 may rotate the head part 110*h* in the first direction until the sound source 10 is included in the image 610 input through the camera 170.

If the determination result indicates that the sound source 10 is recognized through the camera 170, in operation 707, the processor 160 may rotate the head part 110*h* in a second direction or according to a second rotation adjustment (e.g., a finer adjustment). If the head part 110*h* rotates in the second direction, in operation 709, the processor 160 may determine whether the sound source 10 is included in the specified area 620. If the determination result indicates that the sound source 10 is not included in the specified area 620, the processor 160 may rotate the head part 110*h* in the second direction until the sound source 10 is included in the specified area 620.

If the determination result indicates that the sound source 10 is included in the specified area 620, in operation 711, the sensor 130 may sense the rotation angle of the head part 110*h*. If the rotation angle of the head part 110*h* is sensed, in operation 713, the processor 160 may adjust feature parameters of each of the microphones. For example, the sensing of the rotation angle of the head part 110*h* and the adjusting of the feature parameters may correspond to the operation described in FIG. 3.

Figure 8:
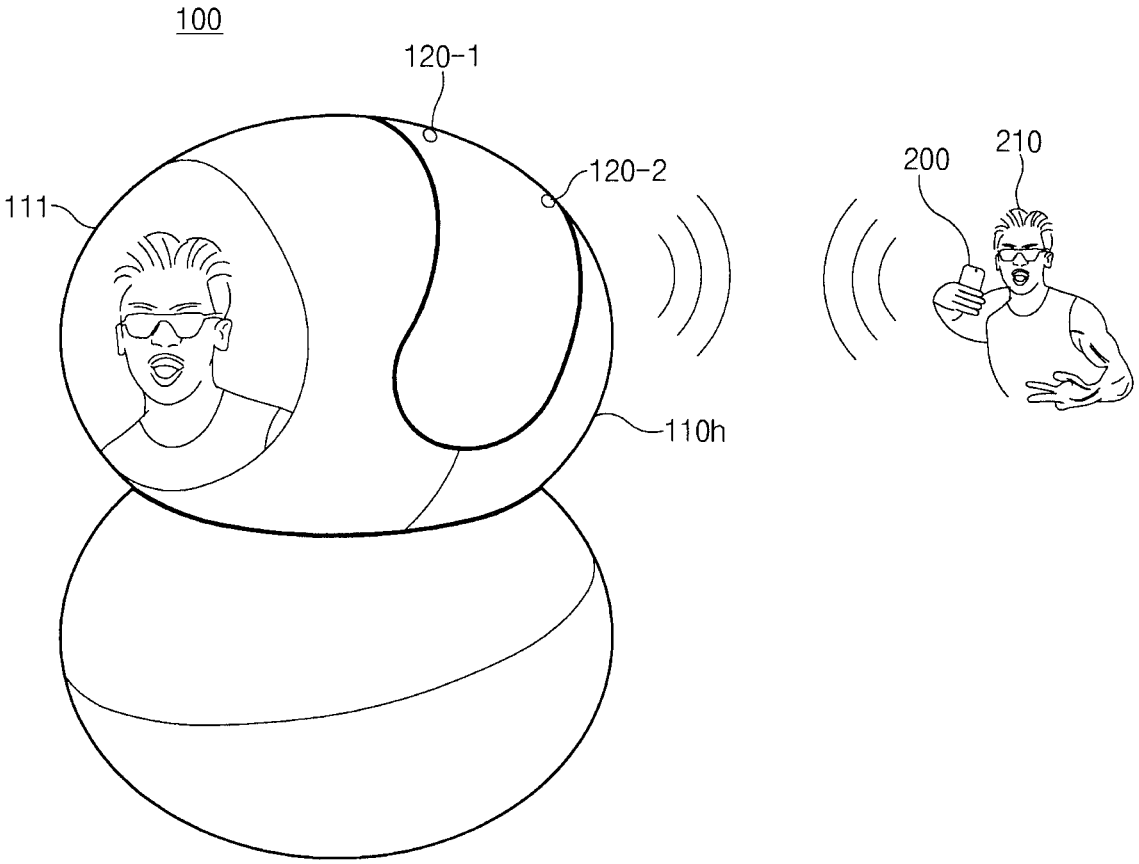
FIG. 8 illustrates an electronic device in which a display is disposed on one surface of a head part, according to another embodiment.

FIG. 8 illustrates the electronic device 100 in which the display 190 is disposed on the one surface 111 of the head part 110*h*, according to another embodiment of the invention.

Referring to FIG. 8, the communication interface 180 may transmit or receive data to or from an external device 200 (e.g., a smartphone or a tablet PC). The data may include an image of a user 210 (e.g., such as their face) of the external device 200 that is detected through the camera of the external device 200. If the data is received, the processor 160 may output the facial image of the user 210 of the external device 200 to the display 190.

The data may include a text entered in the external device 200 by the user 210 of the external device 200 or voice information of the user 210 of the external device 200, as well as the image. If the data is received, the processor 160 may output the text, which is entered in the external device 200, to the display 190. In addition, if the data is received, the processor 160 may output the voice of the user 210 of the external device 200 through a speaker.

According to an embodiment of the present disclosure, the data may be exchanged through the communication interface 180 and the image may be output to the display 190. Accordingly, a user may make a call and/or a video call to the user 210 of the external device 200.

Figure 9:
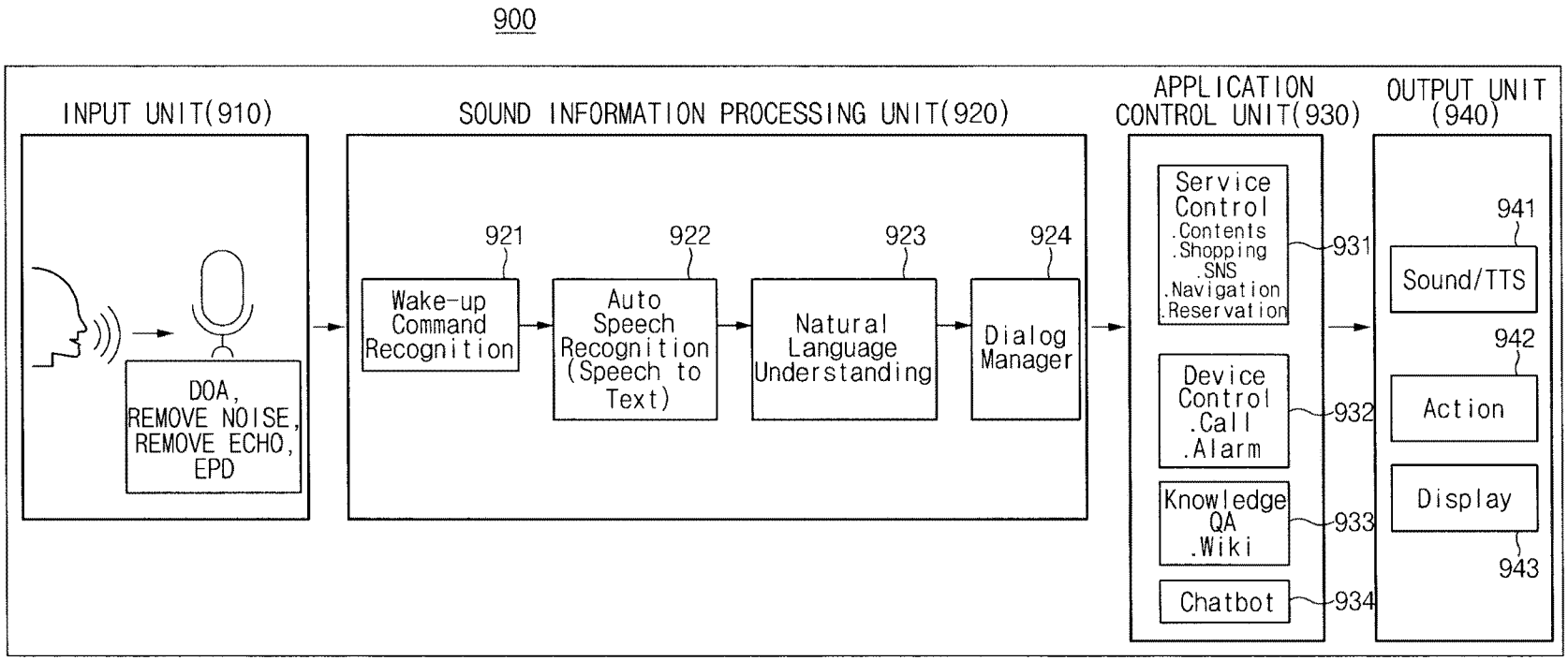
FIG. 9 illustrates a block diagram of a program module, according to an embodiment.

FIG. 9 illustrates a block diagram of a program module, according to an embodiment.

For example, an electronic device 900 illustrates in FIG. 9 may correspond to the electronic device 100 illustrates in FIG. 1. Program modules 910, 920, 930, and 940 to be described below may be stored in the memory 140 and may be executed by the processor 160.

Referring to FIG. 9, the input unit 910 may detect the direction of a sound source. For example, the input unit 910 may detect the direction of the sound source based on a time when sound information is input through a plurality of microphones. The input unit 910 may remove a noise and an echo from sound information, other than voice information, which is input to the electronic device 900. In addition, the input unit 910 may detect the edge point of a sentence from the sound information input to the electronic device 900 (edge point detection). For example, the input unit 910 may detect the edge point of the sentence depending on whether a mute interval is detected. The mute interval indicates a time period in which the sound information is not collected after a specific sentence is completed or otherwise entered.

The sound information processing unit 920 may include a sentence start recognition unit 921, a sentence detection unit 922, a natural sound detection unit 923, and a sentence storage unit 924. The sentence start recognition unit 921 may recognize the start of the sentence input to the electronic device 900 (wake-up command recognition). For example, if the sound information that has a frequency value of a specific size or more after the mute interval is maintained is collected, the sentence start recognition unit 921 may recognize the start of the sentence.

The sentence detection unit 922 may detect the sentence from the sound information input to the electronic device 900 (e.g., auto speech recognition). For example, if both vehicle sound and the sound of a person who is speaking are input to the electronic device 900, the sentence detection unit 922 may filter a voice frequency band to detect the sentence. If the sentence is detected, the sentence storage unit 924 may store the detected sentence in the memory 140 (e.g., dialog manager).

The natural sound detection unit 923 may detect natural sound from the sound information input to the electronic device 900 based on the division of a frequency band (natural language understanding). For example, if both the sound of a dog barking and the sound of a person who is speaking are input to the electronic device 900, the natural sound detection unit 923 may detect the sound of the dog barking.

The application control unit 930 may include a service control unit 931, a device control unit 932, a search unit 933, and a chat unit 934. The service control unit 931 may execute a service application based on the sentence (e.g., an instruction) detected from the sentence detection unit 922. For example, if the word of "Navigation" is included in the sentence detected from the sentence detection unit 922, the service control unit 931 may execute a navigation application.

The device control unit 932 may control the electronic device 900 based on the sentence detected from the sentence detection unit 922. For example, if the sentence detected from the sentence detection unit 922 is "set an alarm to 9 o'clock" the device control unit 932 may set an alarm.

The search unit 933 may search for information, which a user desires, based on the sentence detected from the sentence detection unit 922. For example, if the sentence detected from the sentence detection unit 922 is "search for a type of a microphone", the search unit 933 may search for a type of a microphone. The chat unit 934 may execute a chat application and may output the sentence detected from the sentence detection unit 922 to a chat box.

The output unit 940 may include a sound output unit 941, a vibration unit 942, and a screen output unit 943. The sound output unit 941 may output the sound, which is generated when an application is executed, through a speaker. For example, when an alarm application is executed, the set alarm may be output through the speaker. When an application is executed or ends, the vibration unit 942 may vibrate the electronic device 900. The screen output unit 943 may output the operating state of the application to the display 190.

Figure 10:
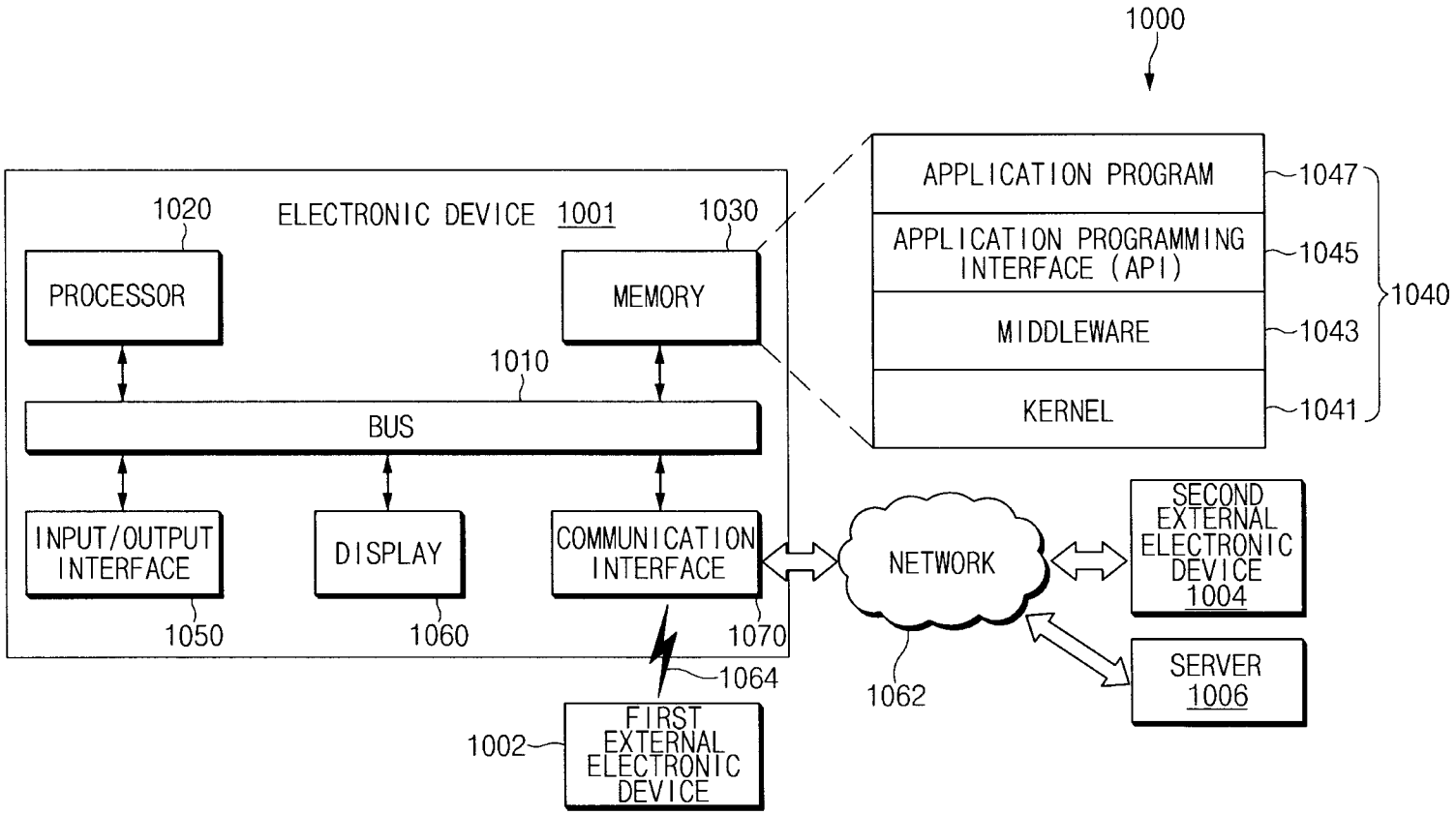
FIG. 10 illustrates the electronic device in a network environment according to various embodiments.

FIG. 10 illustrates an electronic device in a network environment system 1000, according to an embodiment.

Referring to FIG. 10, according to an embodiment, an electronic device 1001, a first electronic device 1002, a second electronic device 1004, or a server 1006 may be connected each other over a network 1062 or a short range communication 1064. The electronic device 1001 may include a bus 1010, a processor 1020, a memory 1030, an input/output interface 1050, a display 1060, and a communication interface 1070. According to an embodiment, the electronic device 1001 may not include at least one of the above-described elements or may further include other element(s).

For example, the bus 1010 may interconnect the above-described elements 1010 to 1070 and may include a circuit for conveying communications (e.g., a control message and/or data) among the above-described elements.

The processor 1020 may include one or more of a central processing unit (CPU), an application processor (AP), or a communication processor (CP). For example, the processor 1020 may perform an arithmetic operation or data processing associated with control and/or communication of at least other elements of the electronic device 1001.

The memory 1030 may include a volatile and/or nonvolatile memory. For example, the memory 1030 may store instructions or data associated with at least one other element(s) of the electronic device 1001. According to an embodiment, the memory 1030 may store software and/or a program 1040. The program 1040 may include, for example, a kernel 1041, a middleware 1043, an application programming interface (API) 1045, and/or an application program (or "an application") 1047. At least a part of the kernel 1041, the middleware 1043, or the API 1045 may be referred to as an "operating system (OS)".

For example, the kernel 1041 may control or manage system resources (e.g., the bus 1010, the processor 1020, the memory 1030, and the like) that are used to execute operations or functions of other programs (e.g., the middleware 1043, the API 1045, and the application program 1047). Furthermore, the kernel 1041 may provide an interface that allows the middleware 1043, the API 1045, or the application program 1047 to access discrete elements of the electronic device 1001 so as to control or manage system resources.

The middleware 1043 may perform, for example, a mediation role such that the API 1045 or the application program 1047 communicates with the kernel 1041 to exchange data.

Furthermore, the middleware 1043 may process task requests received from the application program 1047 according to a priority. For example, the middleware 1043 may assign the priority, which makes it possible to use a system resource (e.g., the bus 1010, the processor 1020, the memory 1030, or the like) of the electronic device 1001, to at least one of the application program 1047. For example, the middleware 1043 may process the one or more task requests according to the priority assigned to the at least one, which makes it possible to perform scheduling or load balancing on the one or more task requests.

The API 1045 may be, for example, an interface through which the application program 1047 controls a function provided by the kernel 1041 or the middleware 1043, and may include, for example, at least one interface or function (e.g., an instruction) for a file control, a window control, image processing, a character control, or the like.

The input/output interface 1050 may play a role, for example, of an interface which transmits an instruction or data input from a user or another external device, to other element(s) of the electronic device 1001. Furthermore, the input/output interface 1050 may output an instruction or data, received from other element(s) of the electronic device 1001, to a user or another external device.

The display 1060 may include, for example, a liquid crystal display (LCD), a light-emitting diode (LED) display, an organic LED (OLED) display, a microelectromechanical systems (MEMS) display, or an electronic paper display. The display 1060 may display, for example, various contents (e.g., a text, an image, a video, an icon, a symbol, and the like) to a user. The display 1060 may include a touch screen and may receive, for example, a touch, gesture, proximity, or hovering input using an electronic pen or a part of a user's body.

For example, the communication interface 1070 may establish communication between the electronic device 1001 and an external device (e.g., the first electronic device 1002, the second electronic device 1004, or the server 1006). For example, the communication interface 1070 may be connected to the network 1062 over wireless communication or wired communication to communicate with the external device (e.g., the second electronic device 1004 or the server 1006).

The wireless communication may use at least one of, for example, long-term evolution (LTE), LTE Advanced (LTE-A), Code Division Multiple Access (CDMA), Wideband CDMA (WCDMA), Universal Mobile Telecommunications System (UMTS), Wireless Broadband (WiBro), Global System for Mobile Communications (GSM), or the like, as cellular communication protocol. Furthermore, the wireless communication may include, for example, the short range communication 1064. The short range communication 1064 may include at least one of wireless fidelity (Wi-Fi), Bluetooth, near field communication (NFC), magnetic stripe transmission (MST), a global navigation satellite system (GNSS), or the like.

The MST may generate a pulse in response to transmission data using an electromagnetic signal, and the pulse may generate a magnetic field signal. The electronic device 1001 may transfer the magnetic field signal to point of sale (POS), and the POS may detect the magnetic field signal using a MST reader. The POS may recover the data by converting the detected magnetic field signal to an electrical signal.

The GNSS may include at least one of, for example, a global positioning system (GPS), a global navigation satellite system (Glonass), a Beidou navigation satellite system (hereinafter referred to as "Beidou"), or an European global satellite-based navigation system (hereinafter referred to as "Galileo") based on an available region, a bandwidth, or the like. Hereinafter, in this disclosure, "GPS" and "GNSS" may be interchangeably used. The wired communication may include at least one of, for example, a universal serial bus (USB), a high definition multimedia interface (HDMI), a recommended standard-232 (RS-232), a plain old telephone service (POTS), or the like. The network 1062 may include at least one of telecommunications networks, for example, a computer network (e.g., LAN or WAN), an Internet, or a telephone network.

Each of the first and second electronic devices 1002 and 1004 may be a device of which the type is different from or the same as that of the electronic device 1001. According to an embodiment, the server 1006 may include a group of one or more servers. According to an embodiment, all or a portion of operations that the electronic device 1001 will perform may be executed by another or plural electronic devices (e.g., the first electronic device 1002, the second electronic device 1004 or the server 1006). According to an embodiment, in the case where the electronic device 1001 executes any function or service automatically or in response to a request, the electronic device 1001 may not perform the function or the service internally, but, alternatively additionally, it may request at least a portion of a function associated with the electronic device 1001 from another device (e.g., the electronic device 1002 or 1004 or the server 1006). The other electronic device may execute the requested function or additional function and may transmit the execution result to the electronic device 1001. The electronic device 1001 may provide the requested function or service using the received result or may additionally process the received result to provide the requested function or service. To this end, for example, cloud computing, distributed computing, or client-server computing may be used.

Figure 11:
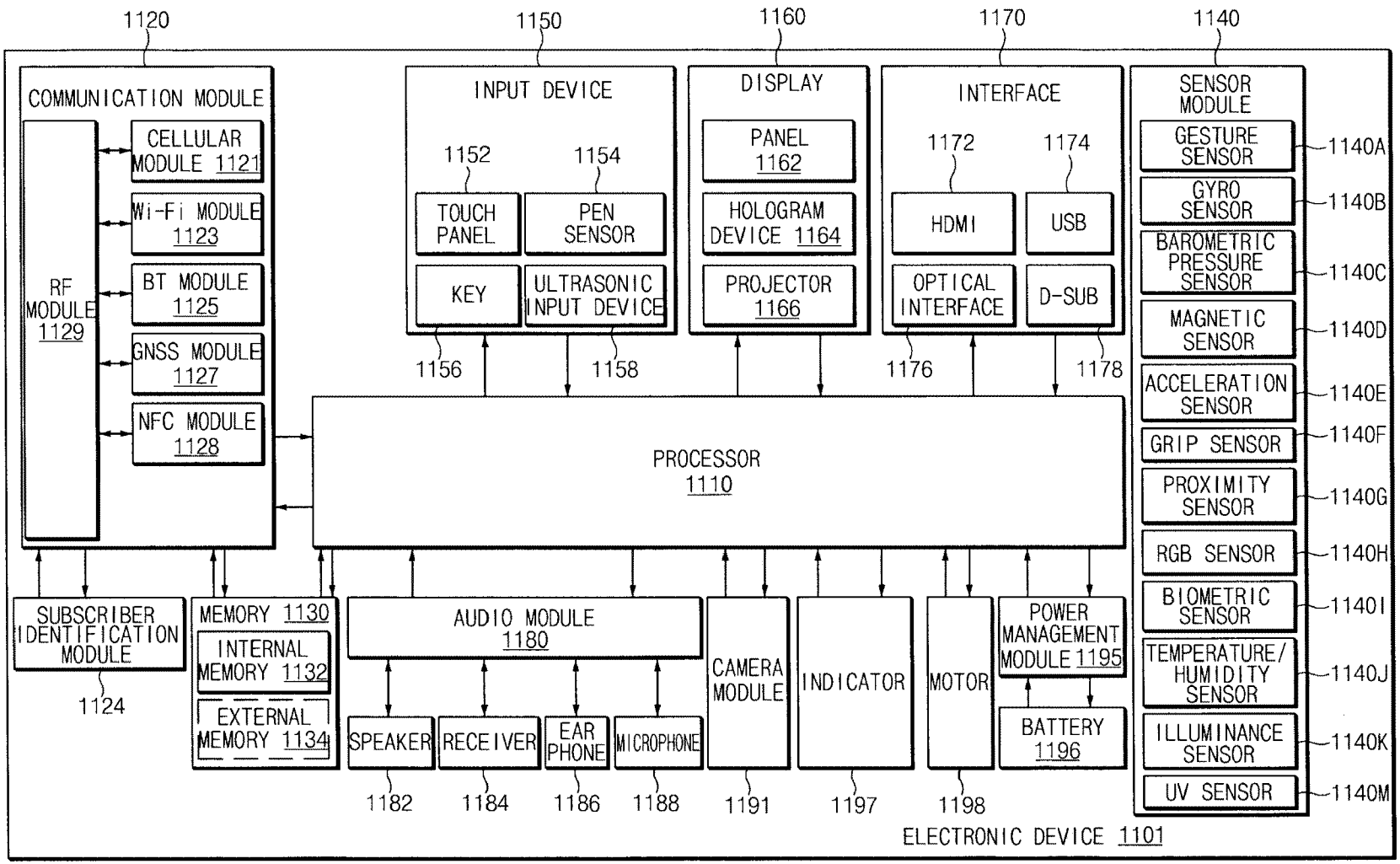
FIG. 11 illustrates a block diagram of an electronic device, according to an embodiment.

FIG. 11 illustrates a block diagram of an electronic device, according to an embodiment.

Referring to FIG. 11, an electronic device 1101 may include, for example, all or a part of the electronic device 1001 illustrates in FIG. 10. The electronic device 1101 may include one or more processors (e.g., an application processor or 'AP') 1110, a communication module 1120, a subscriber identification module 1124, a memory 1130, a sensor module 1140, an input device 1150, a display 1160, an interface 1170, an audio module 1180, a camera module 1191, a power management module 1195, a battery 1196, an indicator 1197, and a motor 1198.

The processor 1110 may drive, for example, an operating system (OS) or an application to control a plurality of hardware or software elements connected to the processor 1110 and may process and compute a variety of data. For example, the processor 1110 may be implemented with a System on Chip (SoC). According to an embodiment, the processor 1110 may further include a graphic processing unit (GPU) and/or an image signal processor. The processor 1110 may include at least a part (e.g., a cellular module 1121) of elements illustrates in FIG. 11. The processor 1110 may load an instruction or data, which is received from at least one of other elements (e.g., a nonvolatile memory), into a volatile memory and process the loaded instruction or data. The processor 1110 may store a variety of data in the nonvolatile memory.

The communication module 1120 may be configured the same as or similar to the communication interface 1070 of FIG. 10. The communication module 1120 may include the cellular module 1121, a Wi-Fi module 1123, a Bluetooth (BT) module 1125, a GNSS module 1127 (e.g., a GPS module, a Glonass module, a Beidou module, or a Galileo module), a near field communication (NFC) module 1128, and a radio frequency (RF) module 1129.

The cellular module 1121 may provide, for example, voice communication, video communication, a character service, an Internet service, or the like over a communication network. According to an embodiment, the cellular module 1121 may perform discrimination and authentication of the electronic device 1101 within a communication network by using the subscriber identification module (e.g., a SIM card) 1124. According to an embodiment, the cellular module 1121 may perform at least a portion of functions that the processor 1110 provides. According to an embodiment, the cellular module 1121 may include a communication processor (CP).

Each of the Wi-Fi module 1123, the BT module 1125, the GNSS module 1127, or the NFC module 1128 may include a processor for processing data exchanged through a corresponding module, for example. According to an embodiment, at least a part (e.g., two or more) of the cellular module 1121, the Wi-Fi module 1123, the BT module 1125, the GNSS module 1127, or the NFC module 1128 may be included within one Integrated Circuit (IC) or an IC package.

For example, the RF module 1129 may transmit and receive a communication signal (e.g., an RF signal). For example, the RF module 1129 may include a transceiver, a power amplifier module (PAM), a frequency filter, a low noise amplifier (LNA), an antenna, or the like. According to another embodiment, at least one of the cellular module 1121, the Wi-Fi module 1123, the BT module 1125, the GNSS module 1127, or the NFC module 1128 may transmit and receive an RF signal through a separate RF module.

The subscriber identification module 1124 may include, for example, a card and/or embedded SIM that includes a subscriber identification module and may include unique identify information (e.g., integrated circuit card identifier (ICCID)) or subscriber information (e.g., integrated mobile subscriber identity (IMSI)).

The memory 1130 (e.g., the memory 1030) may include an internal memory 1132 or an external memory 1134. For example, the internal memory 1132 may include at least one of a volatile memory (e.g., a dynamic random access memory (DRAM), a static RAM (SRAM), a synchronous DRAM (SDRAM), or the like), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory or a NOR flash memory), or the like), a hard drive, or a solid state drive (SSD).

The external memory 1134 may further include a flash drive such as compact flash (CF), secure digital (SD), micro secure digital (Micro-SD), mini secure digital (Mini-SD), extreme digital (xD), a multimedia card (MMC), a memory stick, or the like. The external memory 1134 may be operatively and/or physically connected to the electronic device 1101 through various interfaces.

A security module 1136 may be a module that includes a storage space of which a security level is higher than that of the memory 1130 and may be a circuit that guarantees safe data storage and a protected execution environment. The security module 1136 may be implemented with a separate circuit and may include a separate processor. For example, the security module 1136 may be in a smart chip or a secure digital (SD) card, which is removable, or may include an embedded secure element (eSE) embedded in a fixed chip of the electronic device 1101. Furthermore, the security module 1136 may operate based on an operating system (OS) that is different from the OS of the electronic device 1101. For example, the security module 1136 may operate based on Java card open platform (JCOP) OS.

The sensor module 1140 may measure, for example, a physical quantity or may detect an operation state of the electronic device 1101. The sensor module 1140 may convert the measured or detected information to an electric signal. For example, the sensor module 1140 may include at least one of a gesture sensor 1140A, a gyro sensor 1140B, a barometric pressure sensor 1140C, a magnetic sensor 1140D, an acceleration sensor 1140E, a grip sensor 1140F, the proximity sensor 1140G, a color sensor 1140H (e.g., red, green, blue (RGB) sensor), a biometric sensor 1140I, a temperature/humidity sensor 1140J, an illuminance sensor 1140K, or an UV sensor 1140M. Although not illustrates, additionally or generally, the sensor module 1140 may further include, for example, an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 1140 may further include a control circuit for controlling at least one or more sensors included therein. According to an embodiment, the electronic device 1101 may further include a processor that is a part of the processor 1110 or independent of the processor 1110 and is configured to control the sensor module 1140. The processor may control the sensor module 1140 while the processor 1110 remains at a sleep state.

The input device 1150 may include, for example, a touch panel 1152, a (digital) pen sensor 1154, a key 1156, or an ultrasonic input unit 1158. For example, the touch panel 1152 may use at least one of capacitive, resistive, infrared and ultrasonic detecting methods. Also, the touch panel 1152 may further include a control circuit. The touch panel 1152 may further include a tactile layer to provide a tactile reaction to a user.

The (digital) pen sensor 1154 may be, for example, a part of a touch panel or may include an additional sheet for recognition. The key 1156 may include, for example, a physical button, an optical key, a keypad, or the like. The ultrasonic input unit 1158 may detect (or sense) an ultrasonic signal, which is generated from an input device, through a microphone (e.g., a microphone 1188) and may check data corresponding to the detected ultrasonic signal.

The display 1160 (e.g., the display 1060) may include a panel 1162, a hologram device 1164, or a projector 1166. The panel 1162 may be the same as or similar to the display 1060 illustrates in FIG. 10. The panel 1162 may be implemented, for example, to be flexible, transparent or wearable. The panel 1162 and the touch panel 1152 may be integrated into a single module. The hologram device 1164 may display a stereoscopic image in a space using a light interference phenomenon. The projector 1166 may project light onto a screen so as to display an image. For example, the screen may be arranged in the inside or the outside of the electronic device 1101. According to an embodiment, the display 1160 may further include a control circuit for controlling the panel 1162, the hologram device 1164, or the projector 1166.

The interface 1170 may include, for example, a high-definition multimedia interface (HDMI) 1172, a universal serial bus (USB) 1174, an optical interface 1176, or a D-subminiature (D-sub) 1178. The interface 1170 may be included, for example, in the communication interface 1070 illustrates in FIG. 10. Additionally or generally, the interface 1170 may include, for example, a mobile high definition link (MHL) interface, a SD card/multimedia card (MMC) interface, or an infrared data association (IrDA) standard interface.

The audio module 1180 may convert a sound and an electric signal in dual directions. At least a part of the audio module 1180 may be included, for example, in the input/output interface 1050 illustrates in FIG. 10. The audio module 1180 may process, for example, sound information that is input or output through a speaker 1182, a receiver 1184, an earphone 1186, or the microphone 1188.

For example, the camera module 1191 may shoot a still image or a video. According to an embodiment, the camera module 1191 may include at least one or more image sensors (e.g., a front sensor or a rear sensor), a lens, an image signal processor (ISP), or a flash (e.g., an LED or a xenon lamp).

The power management module 1195 may manage, for example, power of the electronic device 1101. According to an embodiment, a power management integrated circuit (PMIC), a charger IC, or a battery or fuel gauge may be included in the power management module 1195. The PMIC may have a wired charging method and/or a wireless charging method. The wireless charging method may include, for example, a magnetic resonance method, a magnetic induction method or an electromagnetic method and may further include an additional circuit, for example, a coil loop, a resonant circuit, or a rectifier, and the like. The battery gauge may measure, for example, a remaining capacity of the battery 1196 and a voltage, current or temperature thereof while the battery is charged. The battery 1196 may include, for example, a rechargeable battery and/or a solar battery.

The indicator 1197 may display a specific state of the electronic device 1101 or a part thereof (e.g., the processor 1110), such as a booting state, a message state, a charging state, and the like. The motor 1198 may convert an electrical signal into a mechanical vibration and may generate the following effects: vibration, haptic, and the like. Although not illustrates, a processing device (e.g., a GPU) for supporting a mobile TV may be included in the electronic device 1101. The processing device for supporting the mobile TV may process media data according to the standards of digital multimedia broadcasting (DMB), digital video broadcasting (DVB), MediaFlo™, or the like.

Each of the above-mentioned elements of the electronic device according to various embodiments of the present disclosure may be configured with one or more components, and the names of the elements may be changed according to the type of the electronic device. In various embodiments, the electronic device may include at least one of the above-mentioned elements, and some elements may be omitted or other additional elements may be added. Furthermore, some of the elements of the electronic device according to various embodiments may be combined with each other so as to form one entity, so that the functions of the elements may be performed in the same manner as before the combination.

Figure 12:
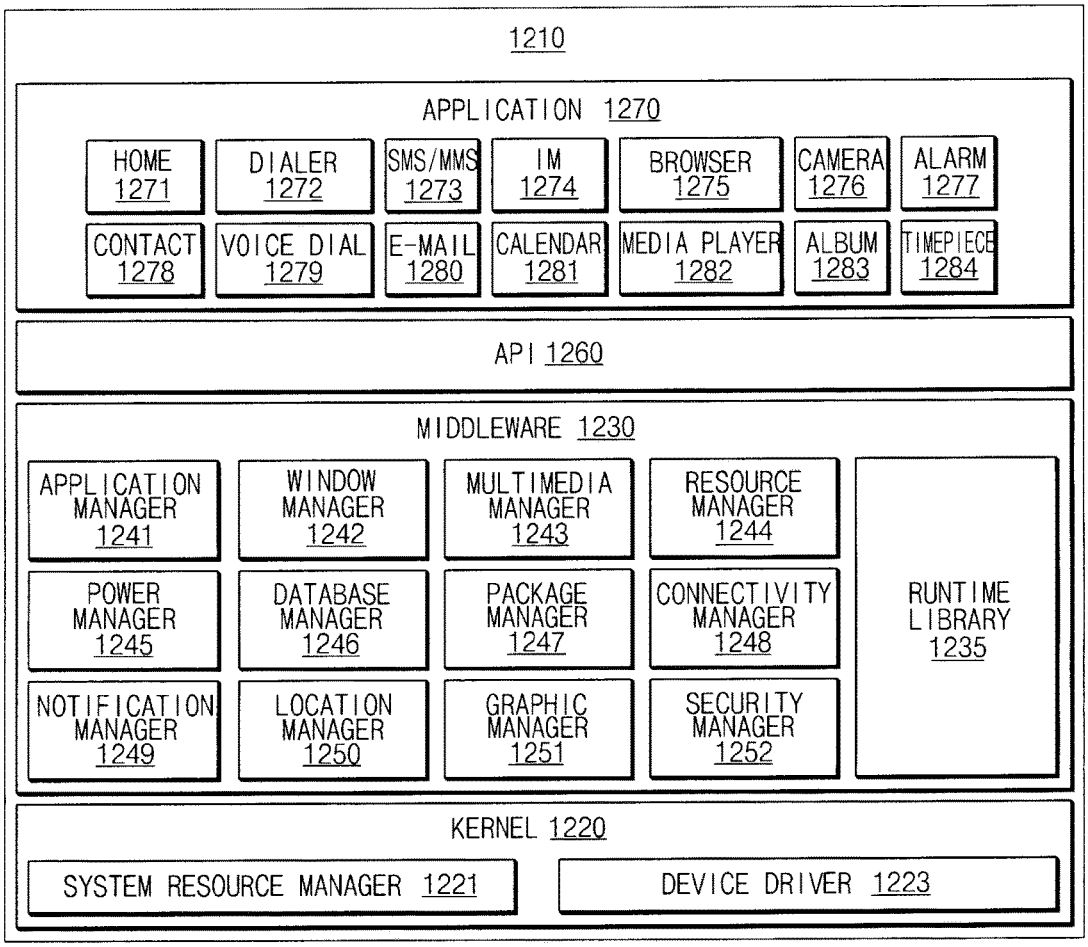
FIG. 12 illustrates a block diagram of a program module, according to an embodiment.

FIG. 12 illustrates a block diagram of a program module, according to various embodiments.

According to an embodiment, a program module 1210 (e.g., the program 1040) may include an operating system (OS) to control resources associated with an electronic device (e.g., the electronic device 1001), and/or diverse applications (e.g., the application program 1047) driven on the OS. The OS may be, for example, Android, iOS, Windows, Symbian, or Tizen.

The program module 1210 may include a kernel 1220, a middleware 1230, an application programming interface (API) 1260, and/or an application 1270. At least a portion of the program module 1210 may be preloaded on an electronic device or may be downloadable from an external electronic device (e.g., the first electronic device 1002, the second electronic device 1004, the server 1006, or the like).

The kernel 1220 (e.g., the kernel 1041) may include, for example, a system resource manager 1221 or a device driver 1223. The system resource manager 1221 may perform control, allocation, or retrieval of system resources. According to an embodiment, the system resource manager 1221 may include a process managing unit, a memory managing unit, or a file system managing unit. The device driver 1223 may include, for example, a display driver, a camera driver, a Bluetooth driver, a shared memory driver, a USB driver, a keypad driver, a Wi-Fi driver, an audio driver, or an inter-process communication (IPC) driver.

The middleware 1230 may provide, for example, a function that the application 1270 needs in common, or may provide diverse functions to the application 1270 through the API 1260 to allow the application 1270 to efficiently use limited system resources of the electronic device. According to an embodiment, the middleware 1230 (e.g., the middleware 1043) may include at least one of a runtime library 1235, an application manager 1241, a window manager 1242, a multimedia manager 1243, a resource manager 1244, a power manager 1245, a database manager 1246, a package manager 1247, a connectivity manager 1248, a notification manager 1249, a location manager 1250, a graphic manager 1251, a security manager 1252, or a payment manager 1254.

The runtime library 1235 may include, for example, a library module that is used by a compiler to add a new function through a programming language while the application 1270 is being executed. The runtime library 1235 may perform input/output management, memory management, or capacities about arithmetic functions.

The application manager 1241 may manage, for example, a life cycle of at least one application of the application 1270. The window manager 1242 may manage a graphic user interface (GUI) resource that is used in a screen. The multimedia manager 1243 may identify a format utilized for playing diverse media files, and may perform encoding or decoding of media files by using a codec suitable for the format. The resource manager 1244 may manage resources such as a storage space, memory, or source code of at least one application of the application 1270.

The power manager 1245 may operate, for example, with a basic input/output system (BIOS) to manage a battery or power, and may provide power information for an operation of an electronic device. The database manager 1246 may generate, search for, or modify database that is to be used in at least one application of the application 1270. The package manager 1247 may install or update an application that is distributed in the form of package file.

The connectivity manager 1248 may manage, for example, wireless connection such as Wi-Fi or Bluetooth. The notification manager 1249 may display or notify an event such as arrival message, appointment, or proximity notification in a mode that does not disturb a user. The location manager 1250 may manage location information about an electronic device. The graphic manager 1251 may manage a graphic effect that is provided to a user, or manage a user interface relevant thereto. The security manager 1252 may provide a general security function utilized for system security, user authentication, or the like. According to an embodiment, in the case where an electronic device (e.g., the electronic device 1001) includes a telephony function, the middleware 1230 may further include a telephony manager for managing a voice or video call function of the electronic device.

The middleware 1230 may include a middleware module that combines diverse functions of the above-described elements. The middleware 1230 may provide a module specialized to each OS kind to provide differentiated functions. Additionally, the middleware 1230 may dynamically remove a part of the preexisting elements or may add new elements thereto.

The API 1260 (e.g., the API 1045) may be, for example, a set of programming functions and may be provided with a configuration that is variable depending on an OS. For example, in the case where an OS is the android or the iOS, it may provide one API set per platform. In the case where an OS is the "Tizen," it may provide two or more API sets per platform.

The application 1270 (e.g., the application program 1047) may include, for example, one or more applications capable of providing functions for a home 1271, a dialer 1272, an SMS/MMS 1273, an instant message (IM) 1274, a browser 1275, a camera 1276, an alarm 1277, a contact 1278, a voice dial 1279, an e-mail 1280, a calendar 1281, a media player 1282, an album 1283, and a timepiece 1284, and/or other apps for offering health care (e.g., measuring an exercise quantity, blood sugar, or the like) or environment information (e.g., information of barometric pressure, humidity, temperature, or the like).

According to an embodiment, the application 1270 may include an application (hereinafter referred to as "information exchanging application" for descriptive convenience) to support information exchange between an electronic device (e.g., the electronic device 1001) and an external electronic device (e.g., the first electronic device 1002 or the second electronic device 1004). The information exchanging application may include, for example, a notification relay application for transmitting specific information to an external electronic device, or a device management application for managing the external electronic device.

For example, the notification relay application may include a function of transmitting notification information, which arise from other applications (e.g., applications for SMS/MMS, e-mail, health care, or environmental information), to an external electronic device. Additionally, the information exchanging application may receive, for example, notification information from an external electronic device and provide the notification information to a user.

The device management application may manage (e.g., install, delete, or update), for example, at least one function (e.g., turn-on/turn-off of an external electronic device itself (or a part of elements) or adjustment of brightness (or resolution) of a display) of the external electronic device which communicates with the electronic device, an application running in the external electronic device, or a service (e.g., a call service, a message service, or the like) provided from the external electronic device.

According to an embodiment, the application 1270 may include an application (e.g., a health care application of a mobile medical device) that is assigned in accordance with an attribute of an external electronic device. According to an embodiment, the application 1270 may include an application that is received from an external electronic device (e.g., the first electronic device 1002, the second electronic device 1004, or the server 1006). According to an embodiment, the application 1270 may include a preloaded application or a third party application that is downloadable from a server.

The names of elements of the program module 1210 according to the embodiment may be modifiable depending on kinds of operating systems.

According to various embodiments, at least a portion of the program module 1210 may be implemented by software, firmware, hardware, or a combination of two or more thereof. At least a portion of the program module 1210 may be implemented (e.g., executed), for example, by the processor (e.g., the processor 1110). At least a portion of the program module 1210 may include, for example, modules, programs, routines, sets of instructions, processes, or the like for performing one or more functions.

The term "module" used in this disclosure may represent, for example, a unit including one or more combinations of hardware, software and firmware. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" may include at least one of an application-specific IC (ASIC) chip, a field-programmable gate array (FPGA), and a programmable-logic device for performing some operations, which are known or will be developed.

At least a part of an apparatus (e.g., modules or functions thereof) or a method (e.g., operations) according to various embodiments may be, for example, implemented by instructions stored in a computer-readable storage media in the form of a program module. The instruction, when executed by a processor (e.g., the processor 1020), may cause the one or more processors to perform a function corresponding to the instruction. The computer-readable storage media, for example, may be the memory 1030.

A computer-readable recording medium may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk)), and hardware devices (e.g., a read only memory (ROM), a random access memory (RAM), or a flash memory). Also, a program instruction may include not only a mechanical code such as things generated by a compiler but also a high-level language code executable on a computer using an interpreter. The above hardware unit may be configured to operate via one or more software modules for performing an operation according to various embodiments, and vice versa.

A module or a program module according to various embodiments may include at least one of the above elements, or a part of the above elements may be omitted, or additional other elements may be further included. Operations performed by a module, a program module, or other elements according to various embodiments may be executed sequentially, in parallel, repeatedly, or in a heuristic method. In addition, some operations may be executed in different sequences or may be omitted. Alternatively, other operations may be added.

While the present disclosure has been shown and described with reference to various embodiments thereof, it will be understood by those skilled in the art that various changes in form and details may be made therein without departing from the present disclosure as defined by the appended claims and their equivalents.

What is claimed is:

1. An electronic device, comprising:

a housing including a head part that is rotatable;

a plurality of microphones disposed in the head part;

a sensor for detecting a rotation angle of the head part;

a memory storing data classifying feature parameters for each of the plurality of microphones according to a plurality of rotation angles;

a motor configured to rotate the head part; and a processor configured to:

when detecting sound by the plurality of microphones originating from a sound source, drive the motor to rotate the head part until a designated portion of a surface of the head part is facing the sound source, and when the designated portion of the surface is facing the sound source, adjust feature parameters for each the plurality of microphones based on the classified feature parameters and a current angle of the head part.

2. The electronic device of claim 1, wherein the processor further configured to detect a direction in which to rotate the head part by detecting a difference in time between a first microphone of the plurality of microphones detecting the sound and a second microphone of the plurality of microphones detecting the sound, and drive the motor to rotate the head part until a designated portion of a surface of the head part is facing the sound source based on the detected direction.

3. The electronic device of claim 1, wherein the feature parameters includes gain, a type of a tonal filter, and a type of a frequency filter.

4. The electronic device of claim 3, wherein the processor further configured to adjust the gain to be proportional to a distance between the sound source and each of the plurality of microphones.

5. The electronic device of claim 1, wherein the rotation angle corresponds to an orientation of the head part with respect to a tri-axis including three axes for three dimensions.

6. The electronic device of claim 1, wherein the processor further configured to:

detect a distance between the sound source and each of the plurality of microphones based on an intensity of the detected sound, and adjust feature parameters for each the plurality of microphones based on the detected distance.

7. The electronic device of claim 1, further comprising at least one of a camera, a display, and a cover glass disposed on a surface of the head part.

8. The electronic device of claim 7, wherein the processor further configured to:

detected a face using the camera; and drive the motor such that the head part is rotated until the designated portion of the surface of the head part faces the detected face.

9. The electronic device of claim 7, further comprising:

a communication interface configured to communicate with an external device, wherein the processor further configured to:

control the display to display an image based on data received by the communication interface.

10. The electronic device of claim 7, wherein the cover glass includes at least one of tempered glass and transparent plastic.

11. The electronic device of claim 1, wherein the sensor includes an inertial measurement unit (IMU) sensor.

12. The electronic device of claim 1, further comprising:

a band including fabric or rubber disposed on the head part.

13. An electronic device, comprising:

a housing including a head part that is rotatable;

a plurality of microphones disposed on the head part;

a sensor for detecting a rotation angle of the head part;

a memory storing data classifying feature parameters of each of the plurality of microphones according to a plurality of rotation angles;

a first motor configured to rotate the head part in a first direction;

a second motor configured to rotate the head part in a second direction;

a camera; and a processor, configured to:

if a sound from a sound source is detected by the plurality of microphones, drive the first motor to rotate the head part until one surface of the head part faces the sound source, if the one surface faces the sound source, detect the sound source using the camera, if the sound source is detected, drive the second motor until the sound source is disposed within a prespecified region of an image captured by the camera, and if the sound source is disposed within the prespecified region, adjust feature parameters of each of the plurality of microphones based on classified feature parameters and a current angle of the head part.

14. The electronic device of claim 13, wherein the processor further configured to detect a direction in which to rotate the head part by detecting a difference in time between a first microphone of the plurality of microphones detecting the sound and a second microphone of the plurality of microphones detecting the sound, and drive the first motor to rotate the head part in a first direction until one surface of the head part faces the sound source.

15. The electronic device of claim 13, wherein the memory further stores an image associated with the sound source, and wherein the processor further configured to:

recognize the sound source by comparing the stored image and the image captured by the camera.

16. The electronic device of claim 15, wherein the processor further configured to:

compare a feature point of the stored image with a feature point of an object included in the image captured by the camera; and when a match is detected indicating similarity the feature point of the stored image and the feature point of the object greater than a predetermined threshold, recognize the object as the sound source.

17. The electronic device of claim 13, wherein a center of the image captured by the camera is included in the prespecified region.

18. The electronic device of claim 13, wherein the feature parameters includes a gain, a type of a tonal filter, and a type of a frequency filter.

19. The electronic device of claim 13, wherein the rotation angle corresponds to an orientation of the head part with respect to a tri-axis including three axes for three dimensions.

20. The electronic device of claim 13, wherein the first direction is perpendicular to the second direction.

* * * * *